US009841701B1

(12) United States Patent
Matsumoto et al.

(10) Patent No.: US 9,841,701 B1
(45) Date of Patent: Dec. 12, 2017

(54) TONER CONTAINER, IMAGE FORMING APPARATUS

(71) Applicant: KYOCERA Document Solutions Inc., Osaka-shi, Osaka (JP)

(72) Inventors: Hiromu Matsumoto, Osaka (JP); Tomohiro Sue, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/393,017

(22) Filed: Dec. 28, 2016

(30) Foreign Application Priority Data

Jun. 8, 2016 (JP) ..... 2016-114510

(51) Int. Cl.
*G03G 15/08* (2006.01)

(52) U.S. Cl.
CPC ..... *G03G 15/0865* (2013.01); *G03G 15/0887* (2013.01)

(58) Field of Classification Search
CPC ..... G03G 15/0865; G03G 15/0887
See application file for complete search history.

(56) References Cited

U.S. PATENT DOCUMENTS 7,593,653 B2 * 9/2009 Richey ..... G03G 15/0856 399/258
7,672,624 B2 * 3/2010 Dawson ..... G03G 21/1647 399/120
2005/0008400 A1 * 1/2005 Tazawa ..... G03G 15/0875 399/263
2011/0217067 A1 9/2011 Tokuno et al.
2011/0236075 A1 * 9/2011 Suzuki ..... G03G 15/0877 399/262
2011/0262189 A1 10/2011 Saito

FOREIGN PATENT DOCUMENTS

JP 2011180598 A 9/2011
KR 101160338 B1 6/2012

OTHER PUBLICATIONS

European Patent Office, Extended European Search Report Issued in European Application No. 16207120.3, dated Jul. 14, 2017, Germany, 7 pages.

* cited by examiner

*Primary Examiner* — G. M. Hyder
(74) *Attorney, Agent, or Firm* — Alleman Hall Creasman & Tuttle LLP

(57) ABSTRACT

A toner container includes a container main body, a rotation member, a flat plate-like lid member, a rib member, and a film member. The rotation member is rotatably provided in the container main body and extends in a depth direction of the container main body. The lid member closes an opening portion of the container main body in the depth direction. The rib member is provided on an inner surface of the lid member in such a way as to be located adjacent to the rotation member with a predetermined gap from the rotation member, and positions the lid member with respect to the opening portion. The film member is attached to the housing of the container main body such that one surface of the film member contacts the rib member and an opposite surface of the film member contacts an outer circumferential surface of the rotation member.

6 Claims, 26 Drawing Sheets

【FIG. 1】
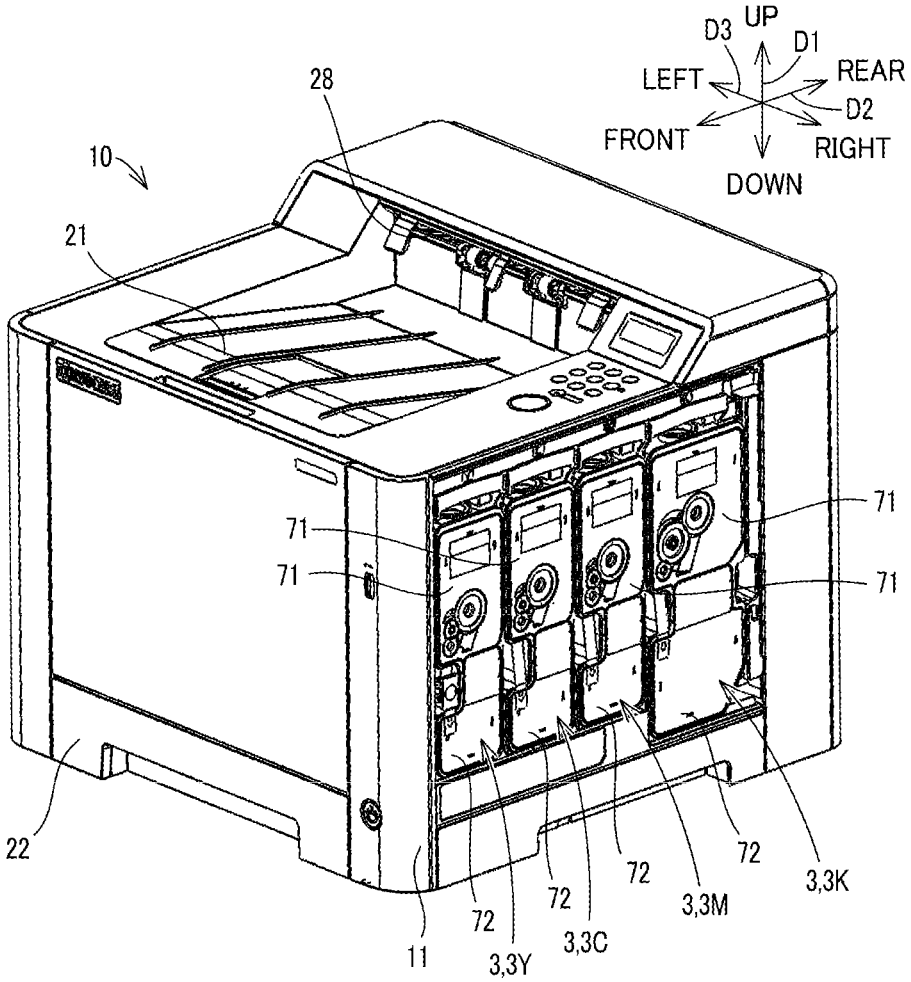

【FIG. 2】
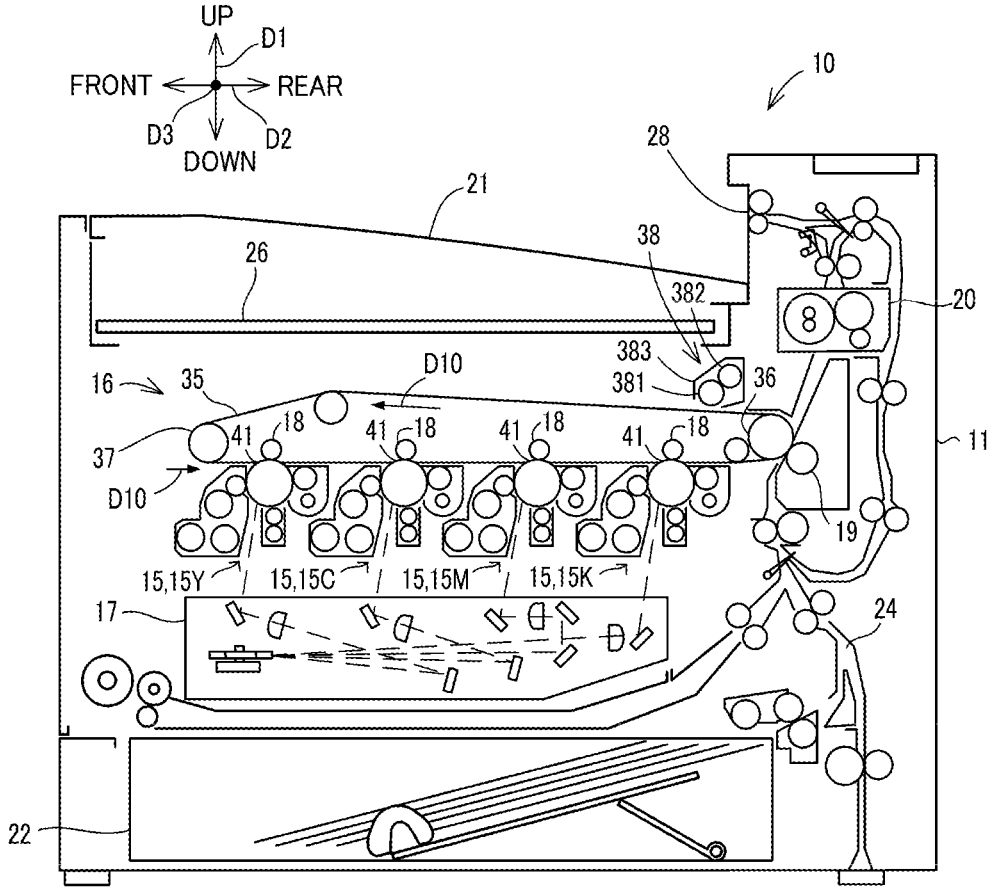

【FIG. 3】
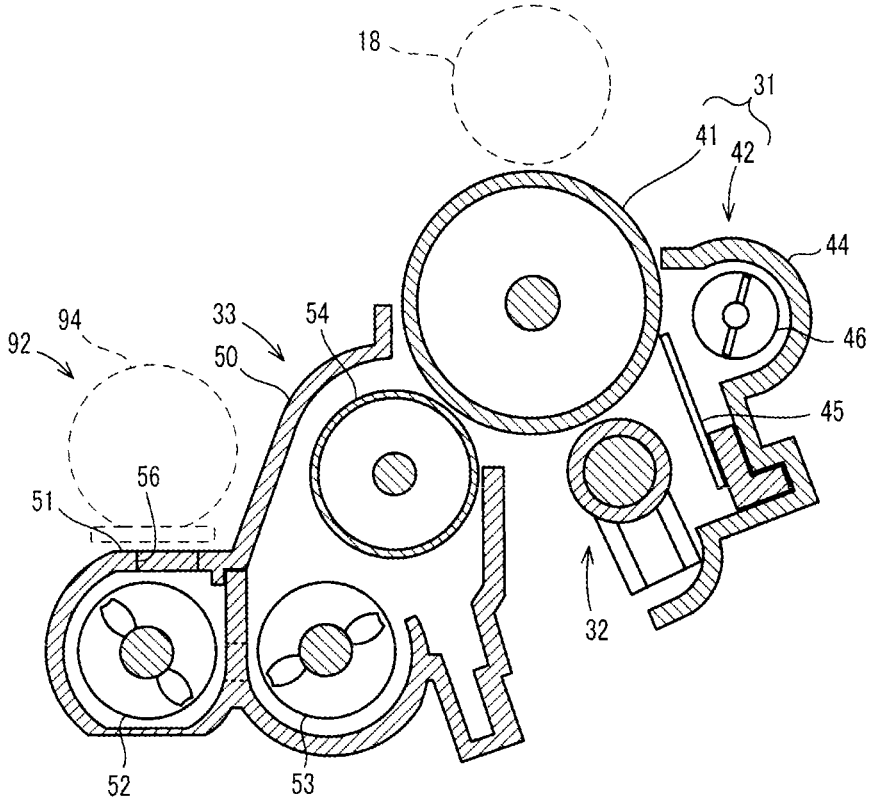

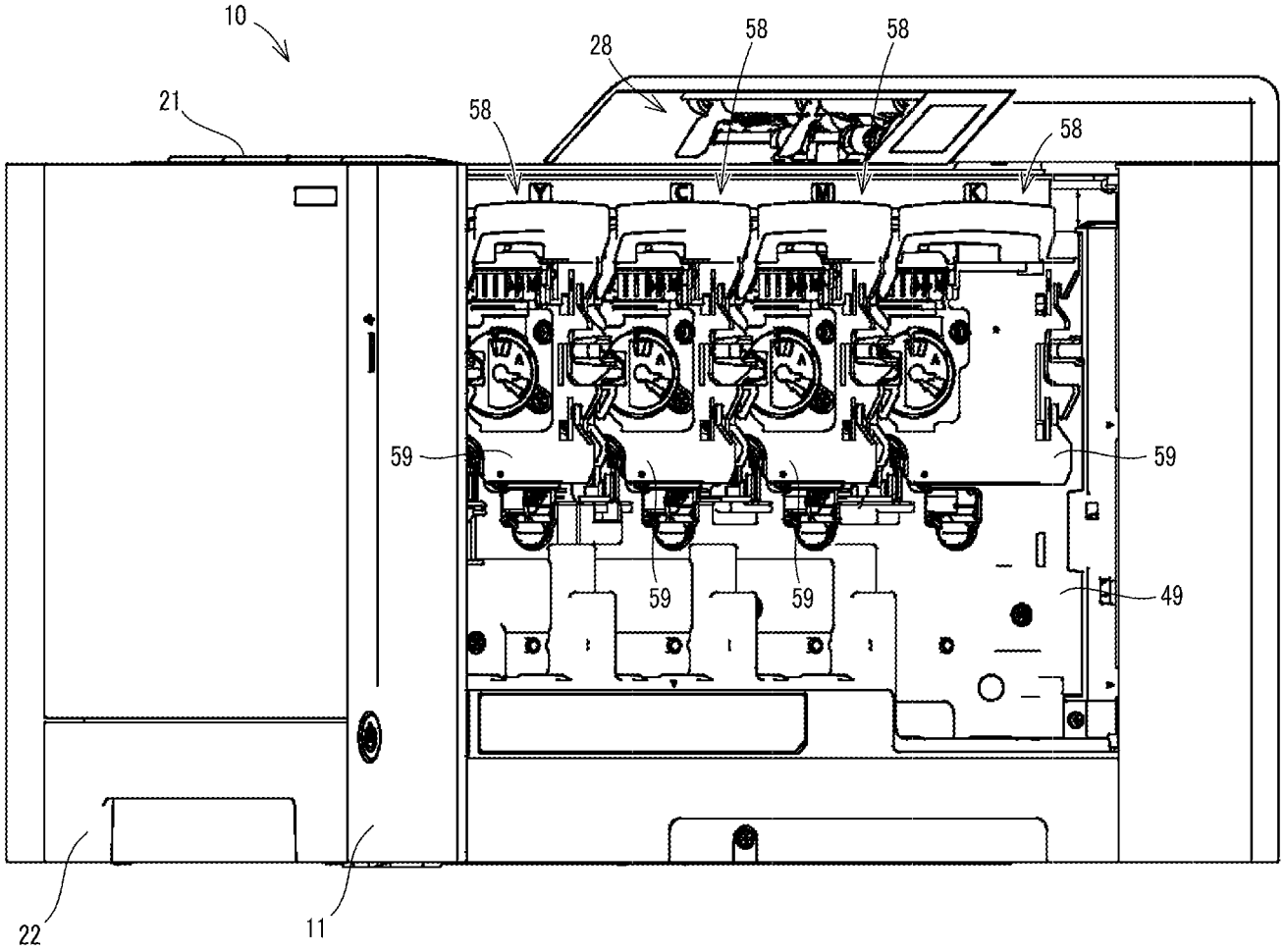
【FIG. 4】

【FIG. 5】
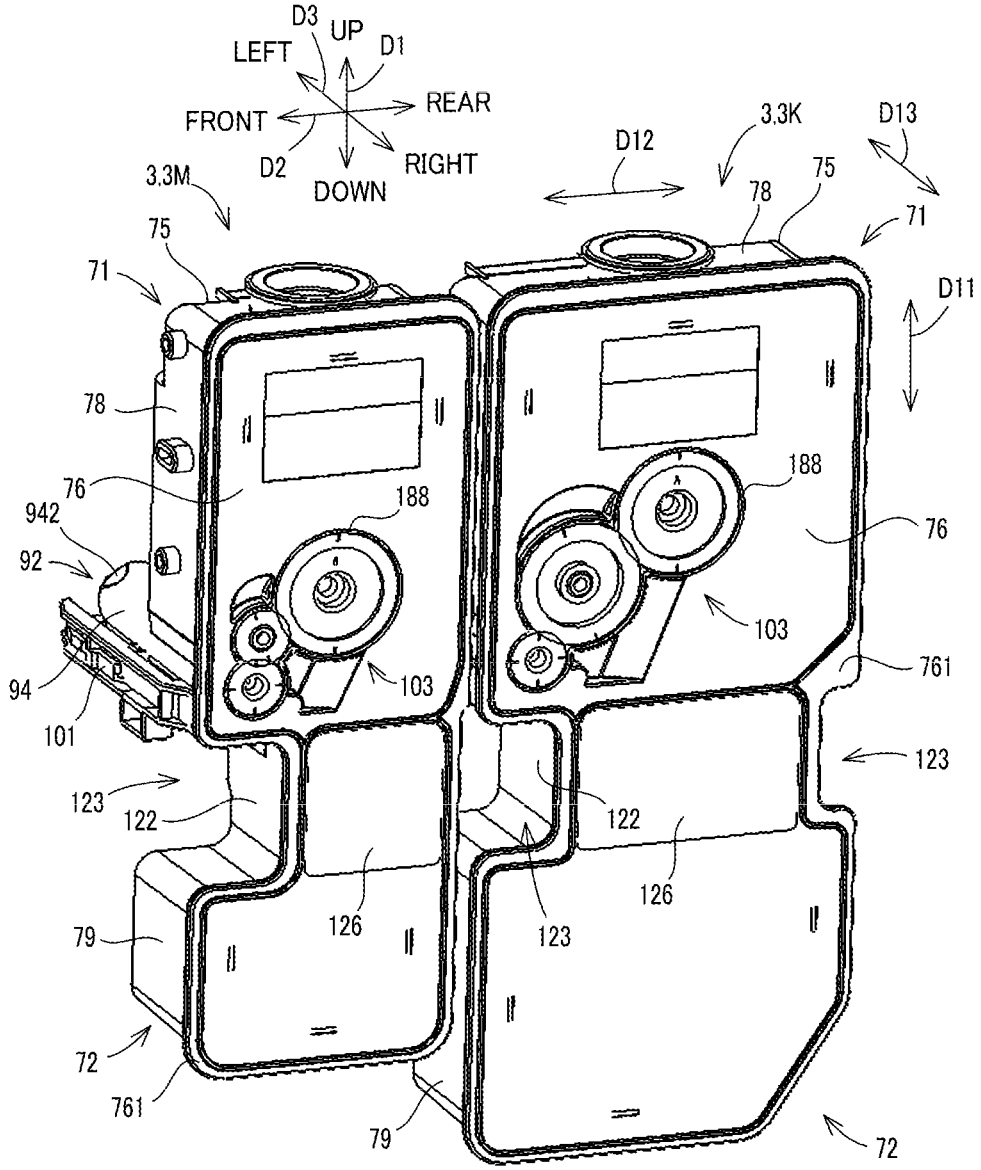

【FIG. 6】
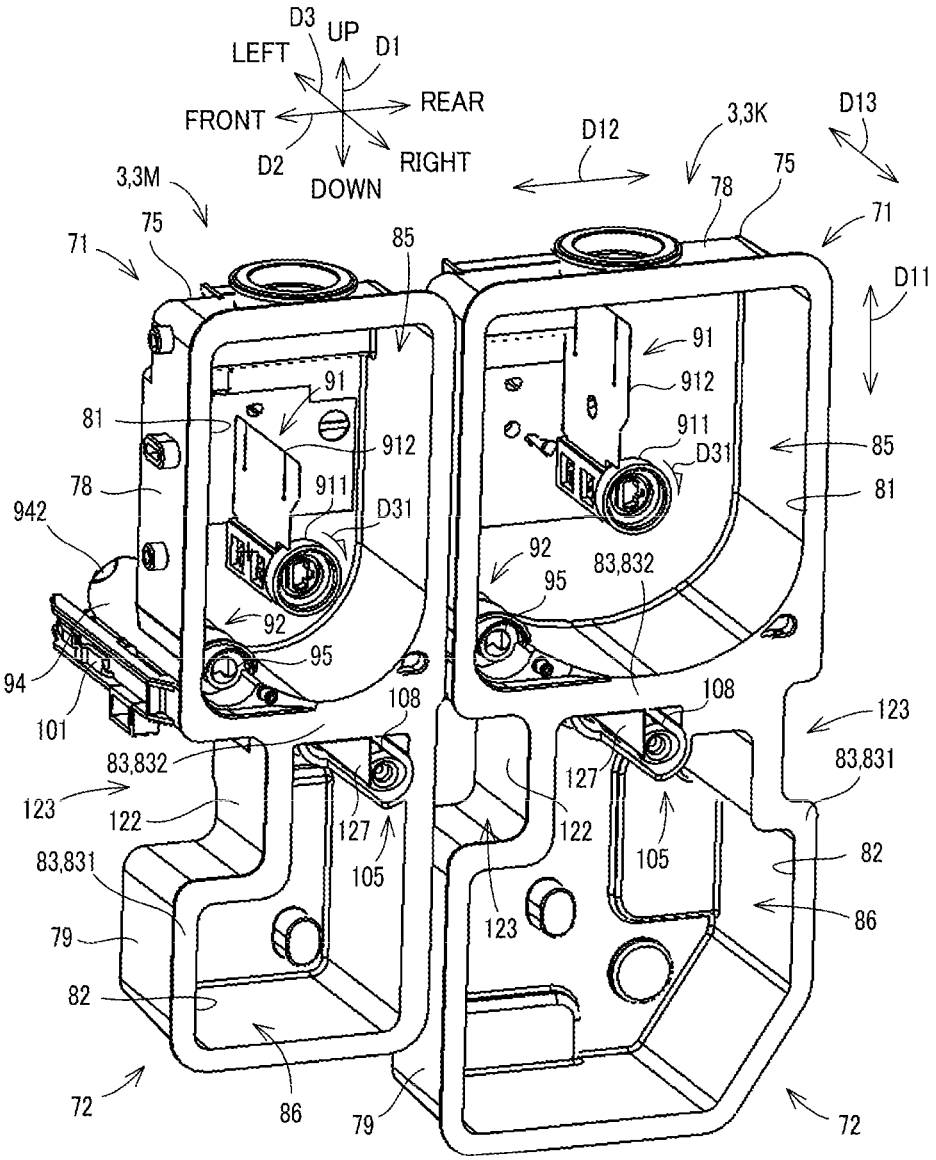

【FIG. 7】
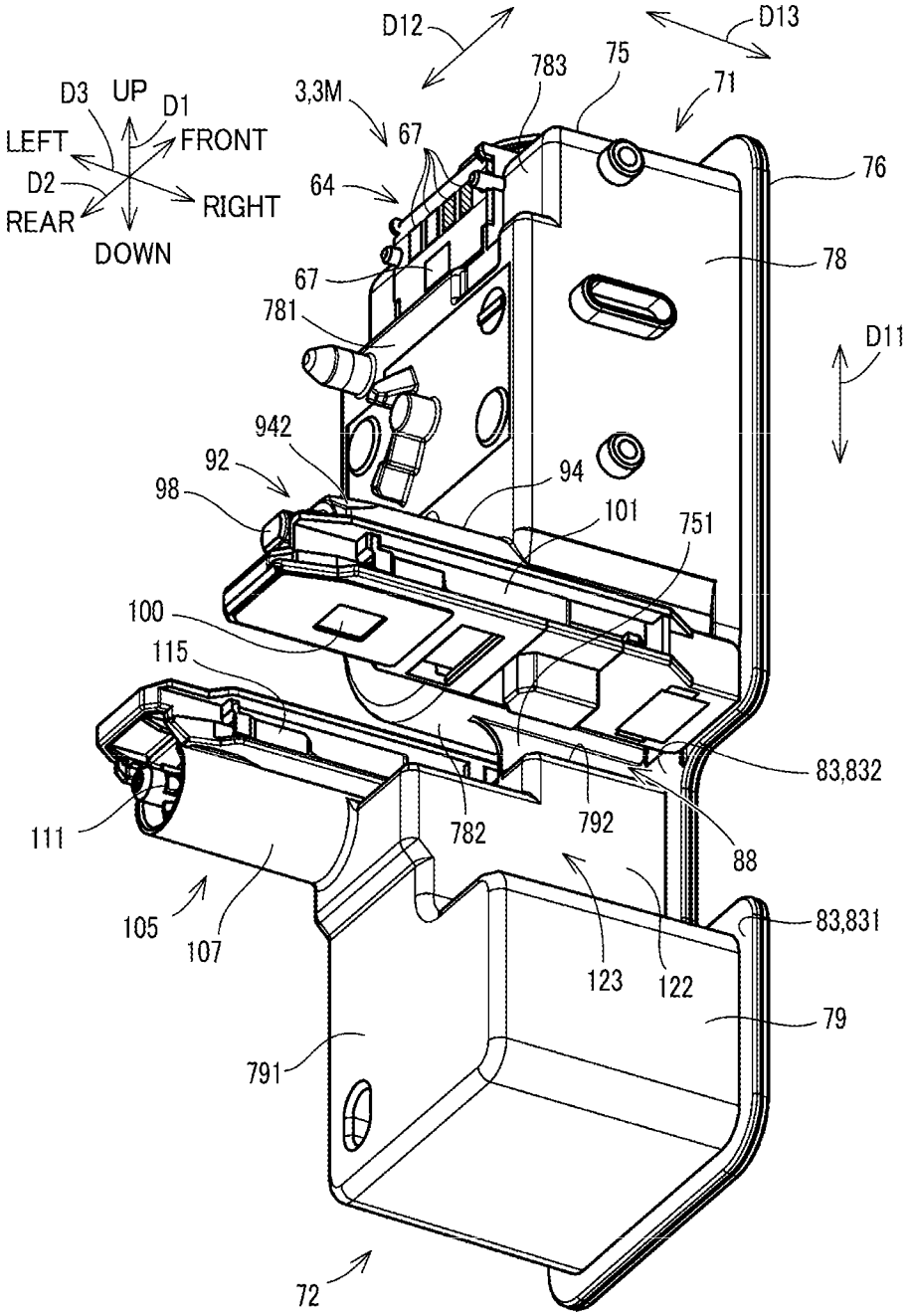

【FIG. 8】
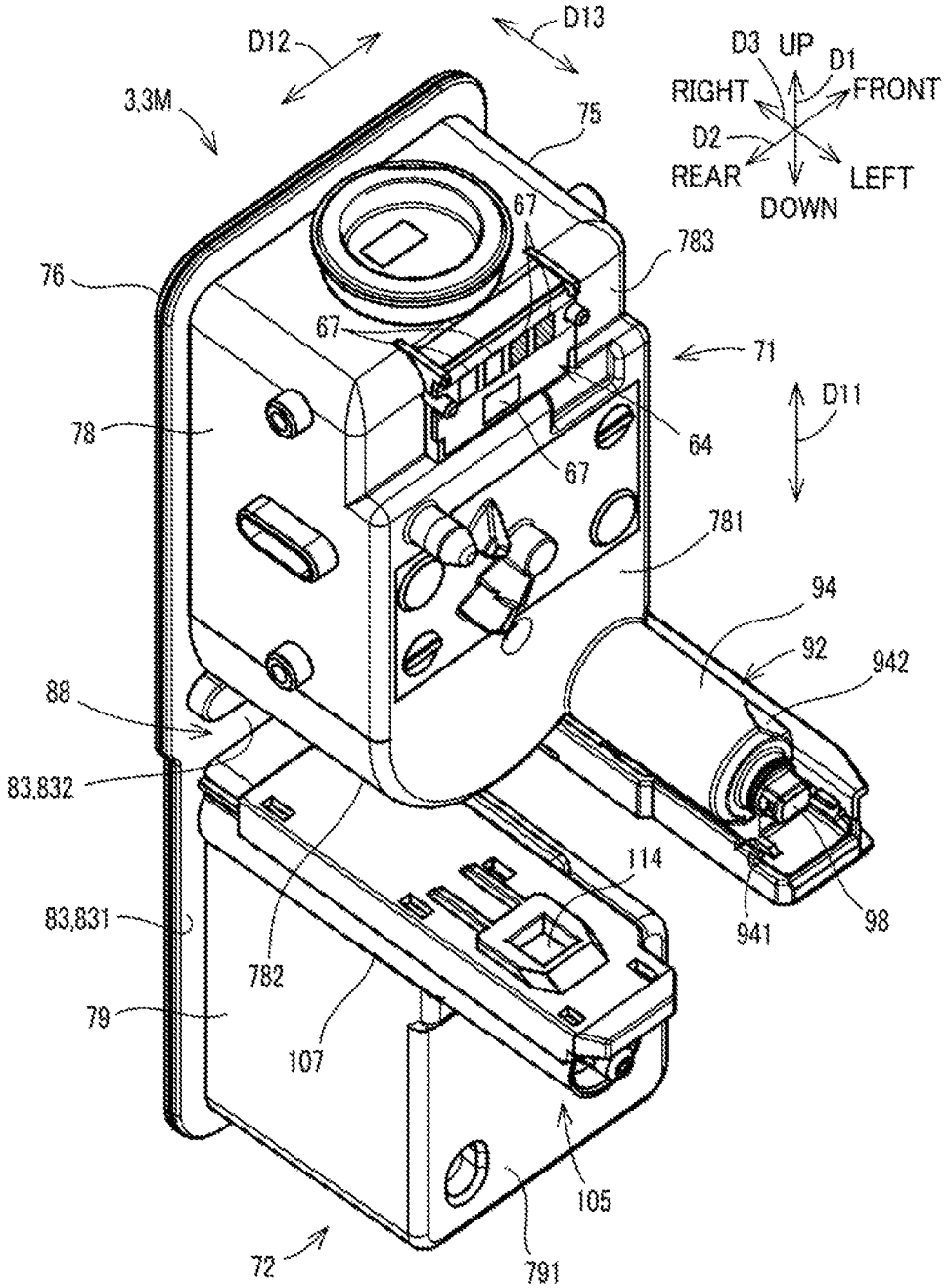

【FIG. 9】
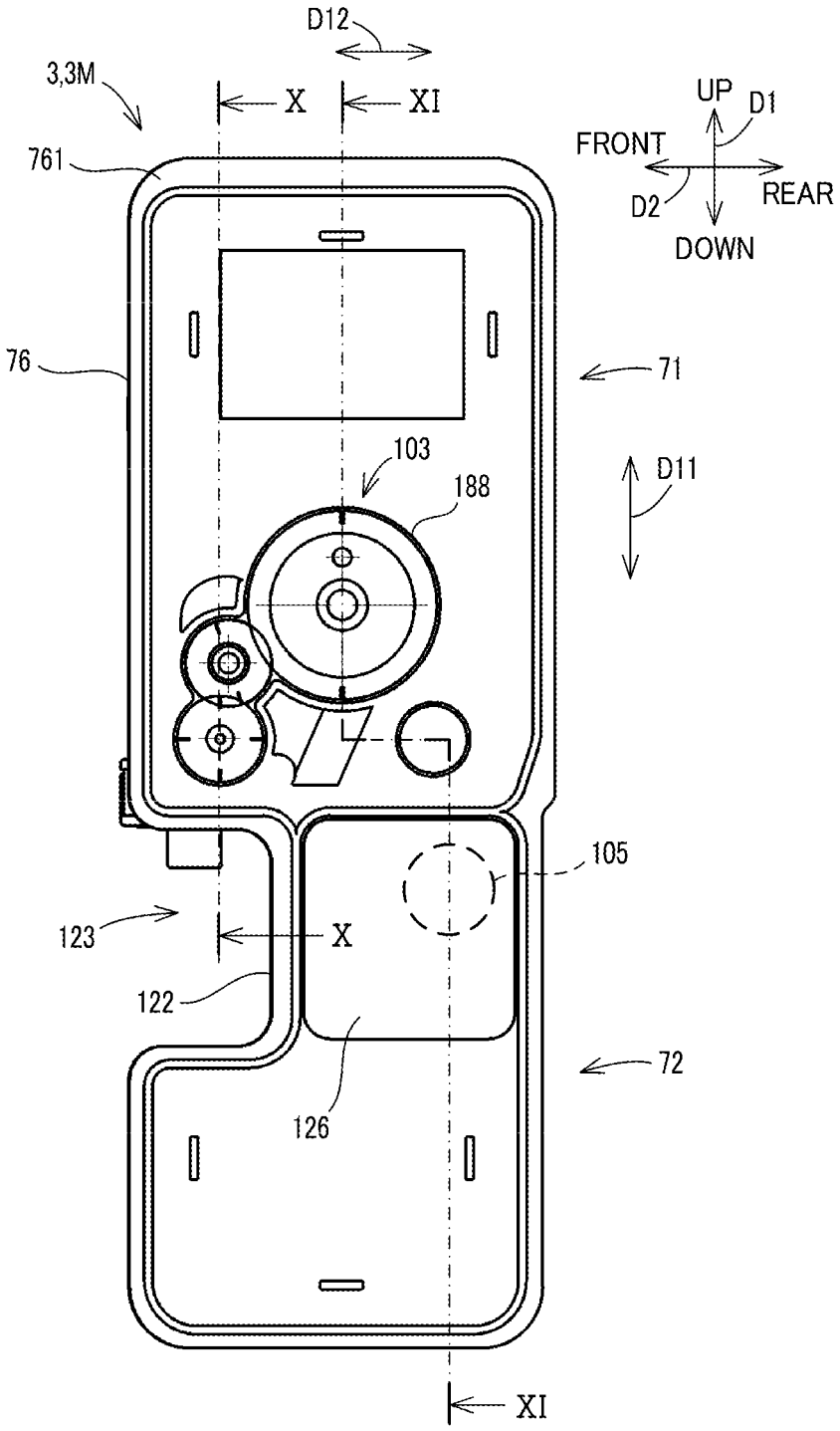

【FIG. 10】
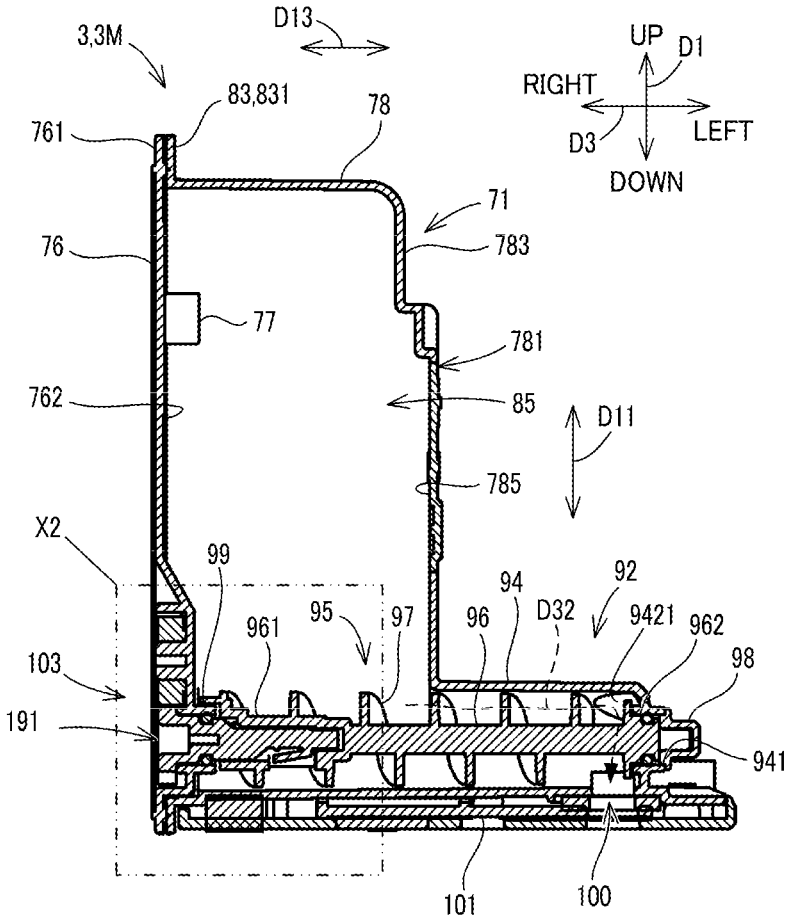

【FIG. 11】
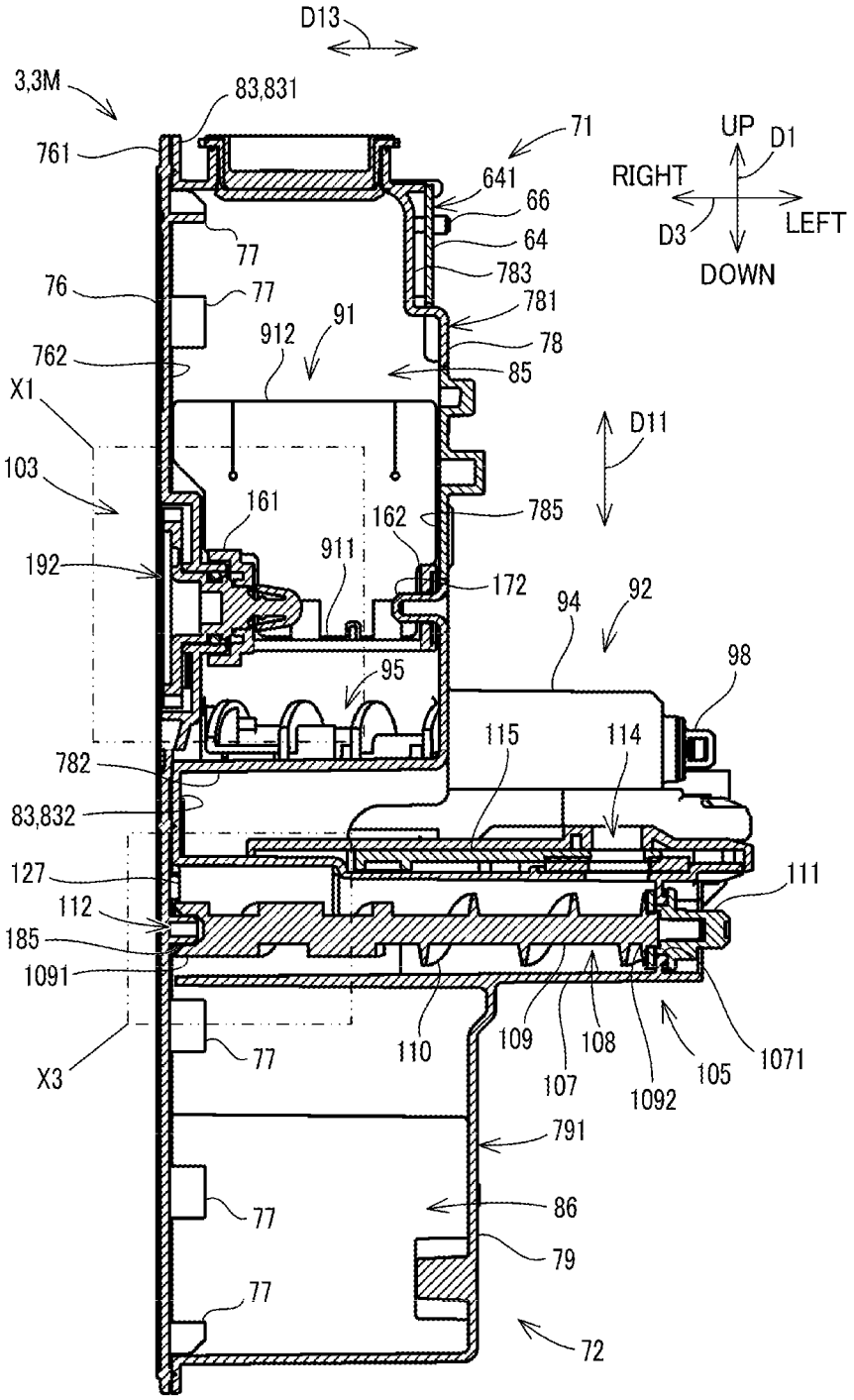

【FIG. 12】
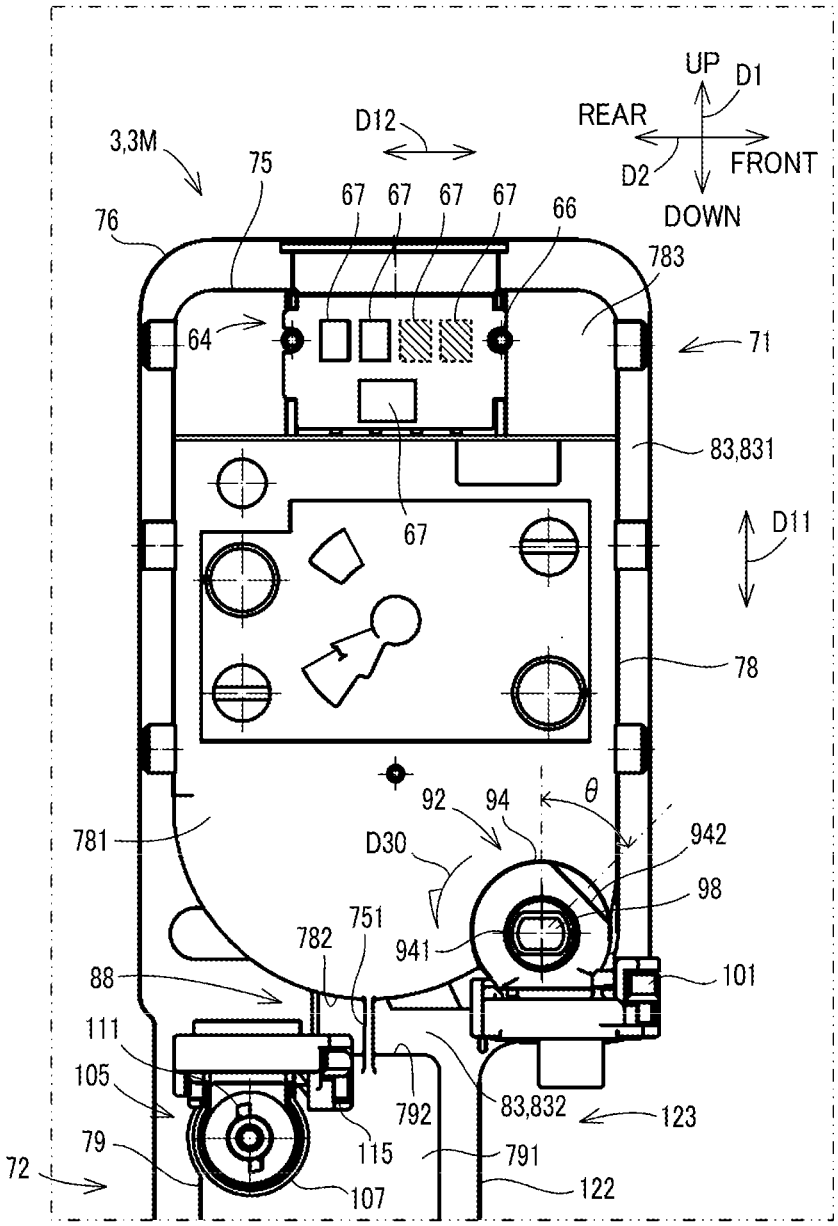

【FIG. 13】
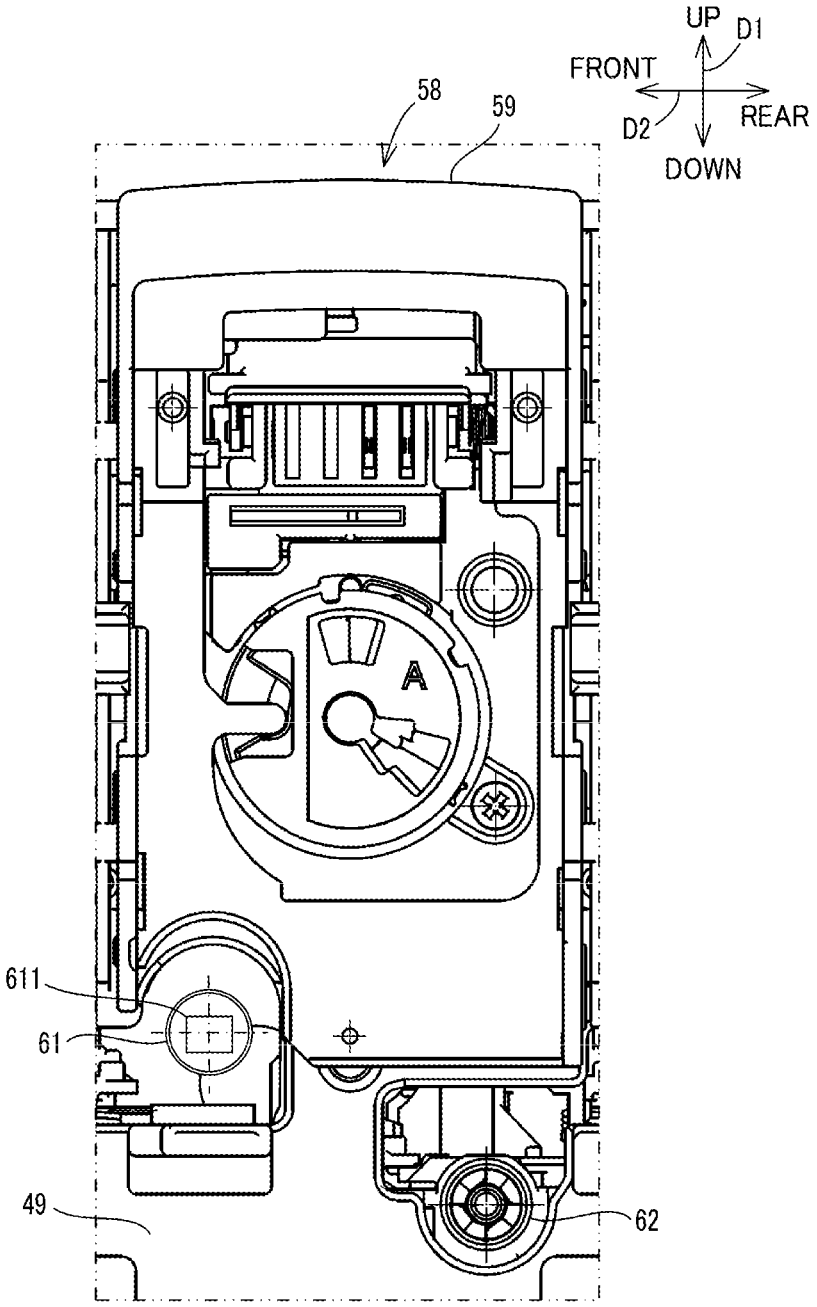

【FIG. 14】
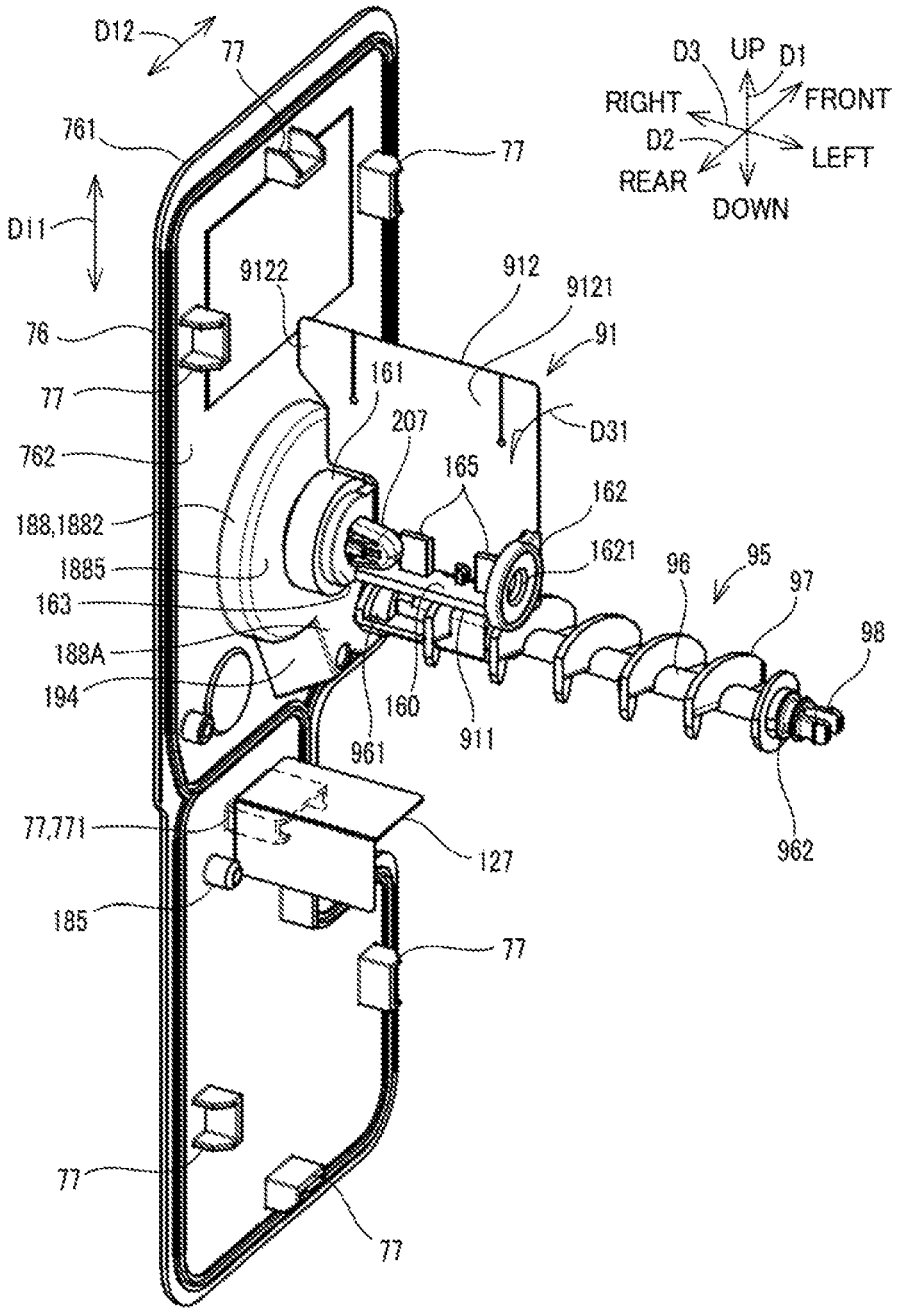

【FIG. 15】
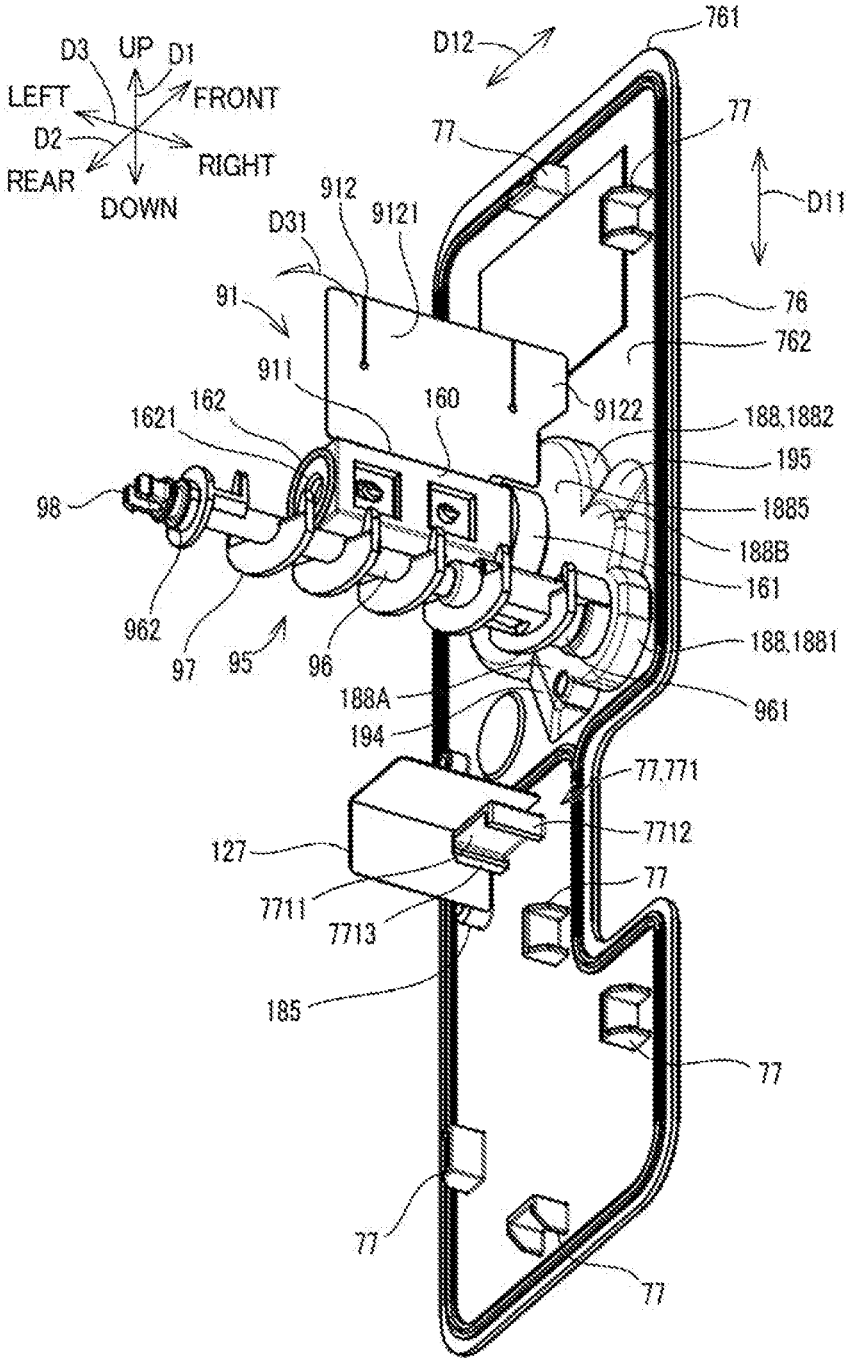

【FIG. 16】
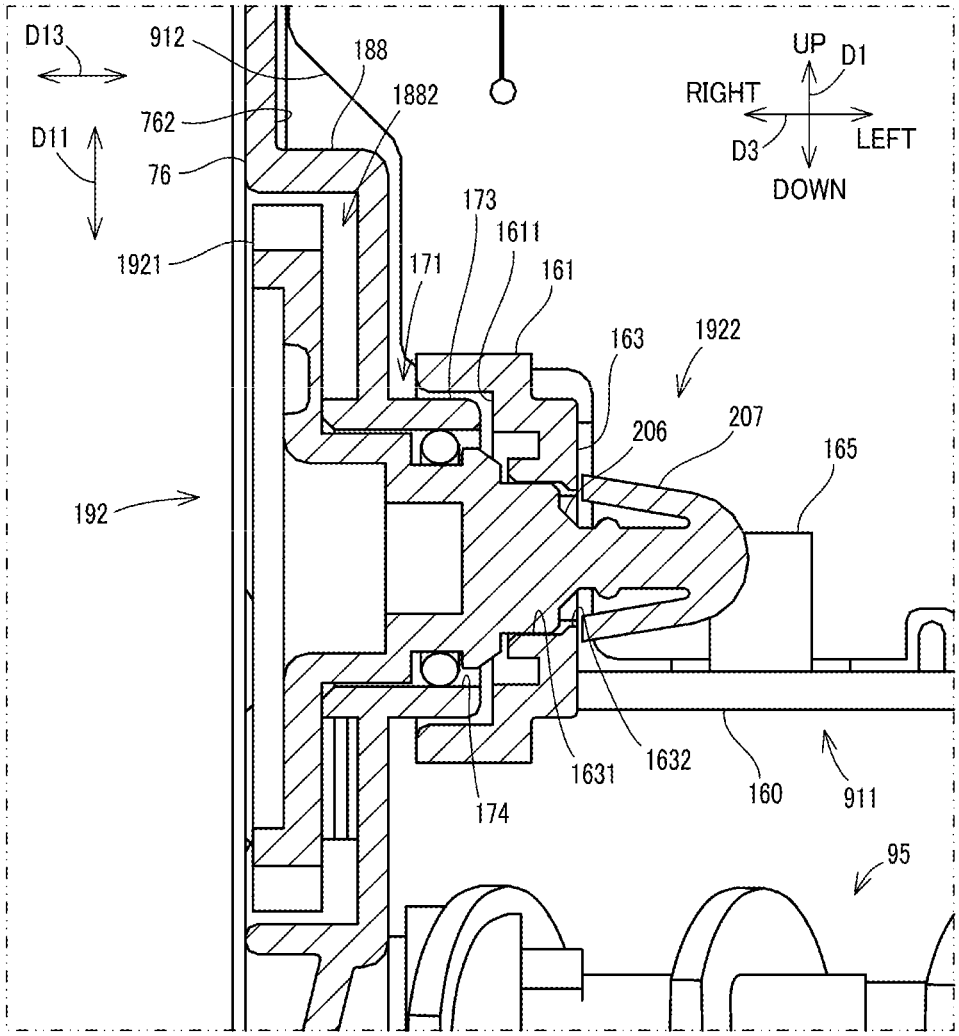

【FIG. 17】
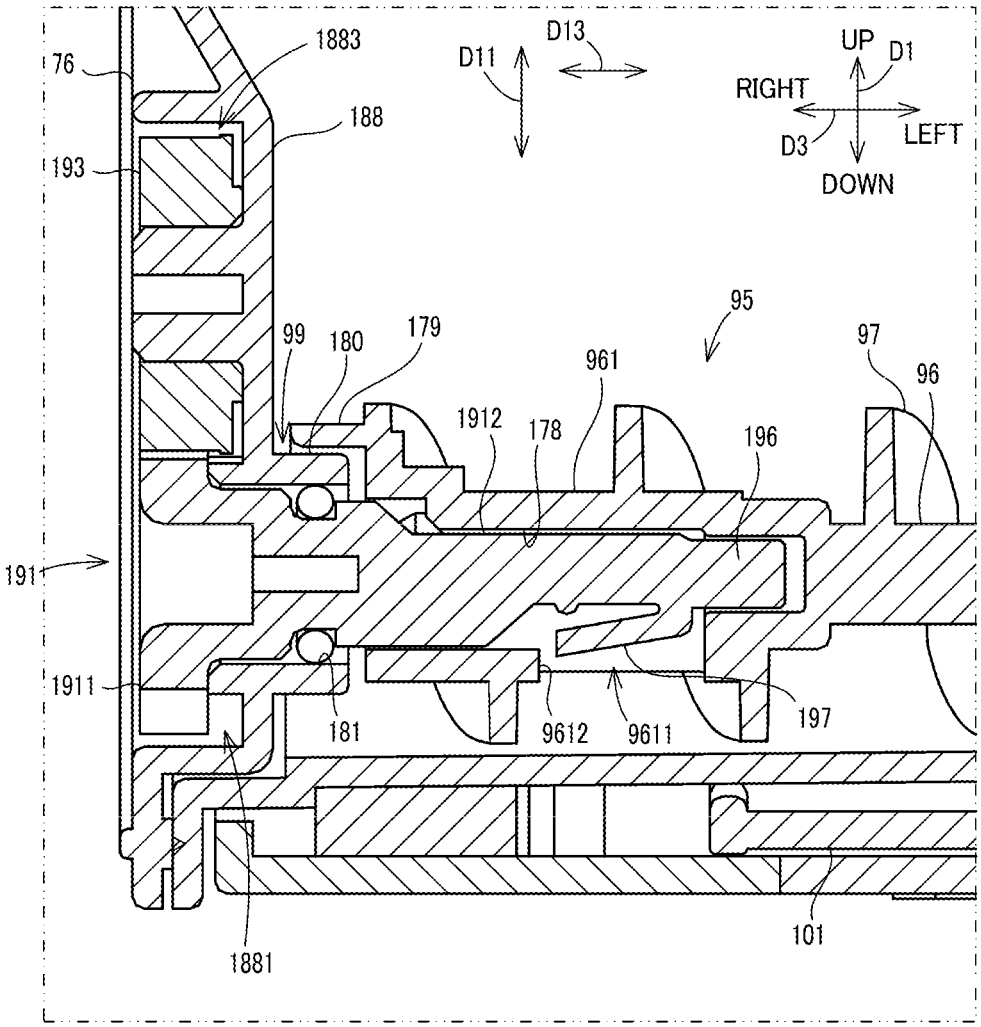

【FIG. 18】
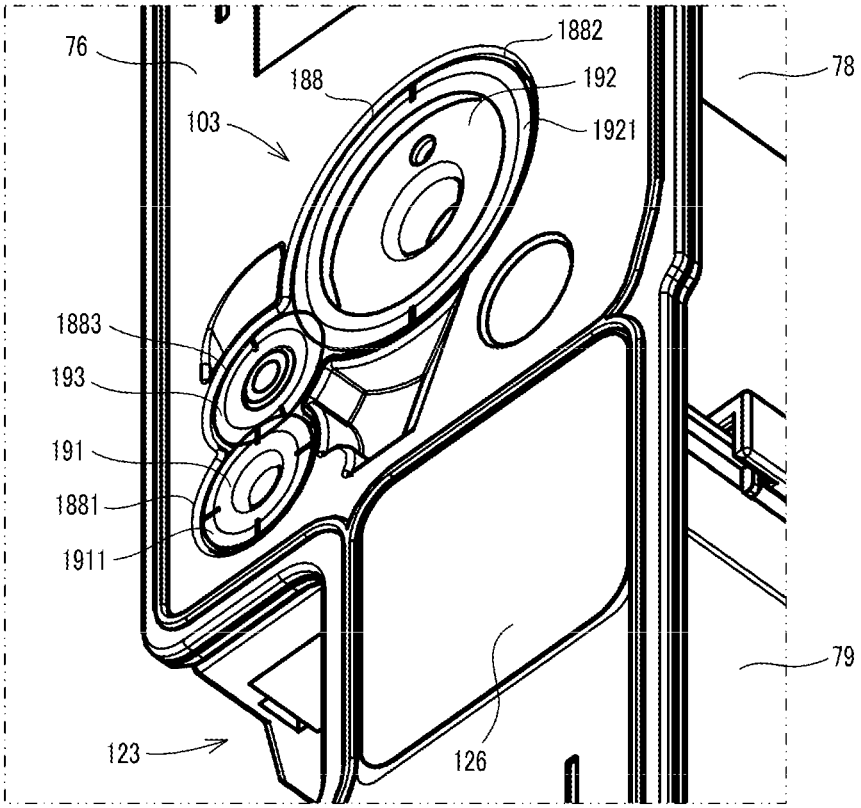

【FIG. 19】
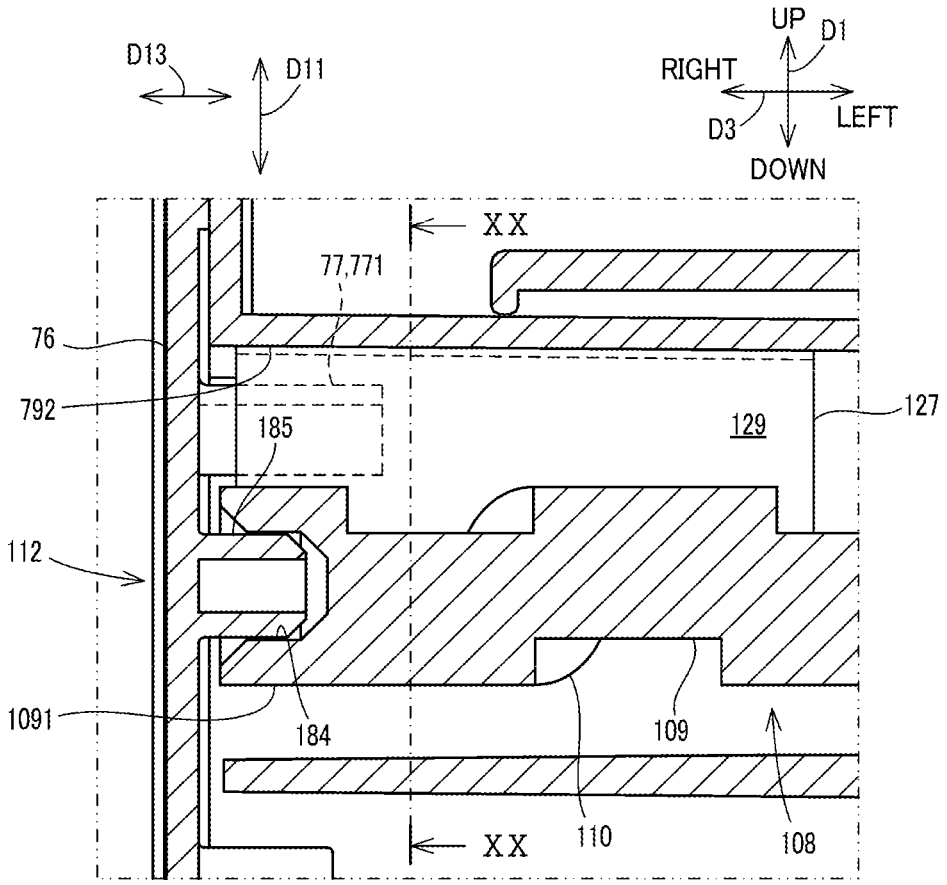

【FIG. 20A】
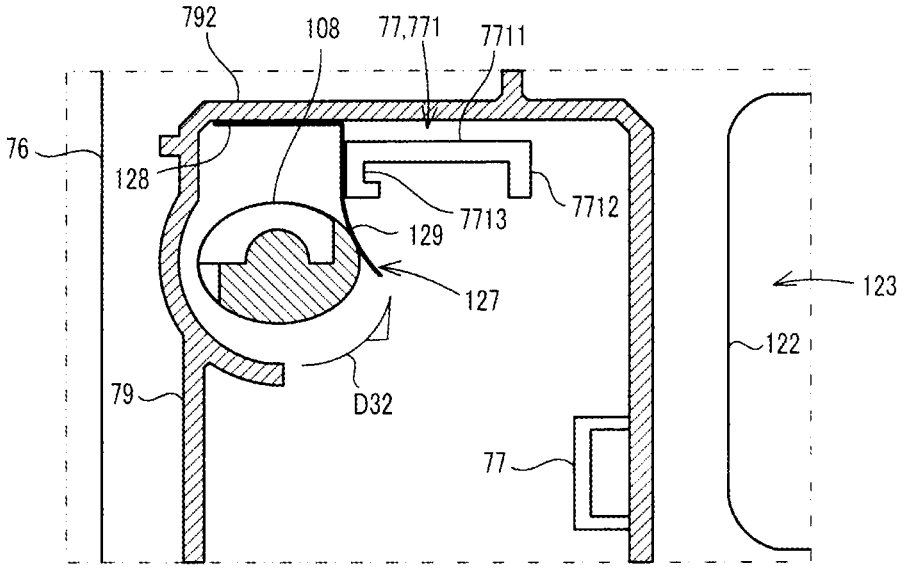
【FIG. 20B】
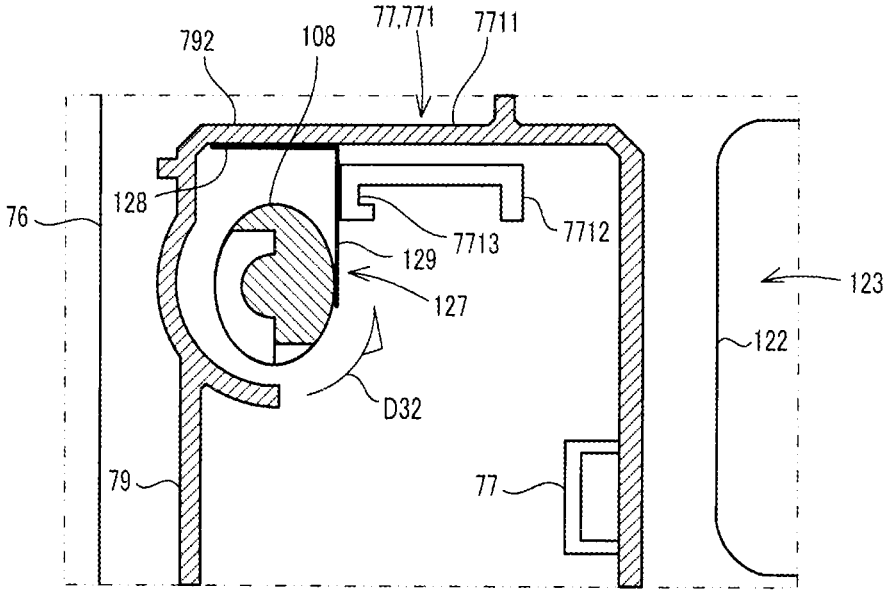

【FIG. 21】
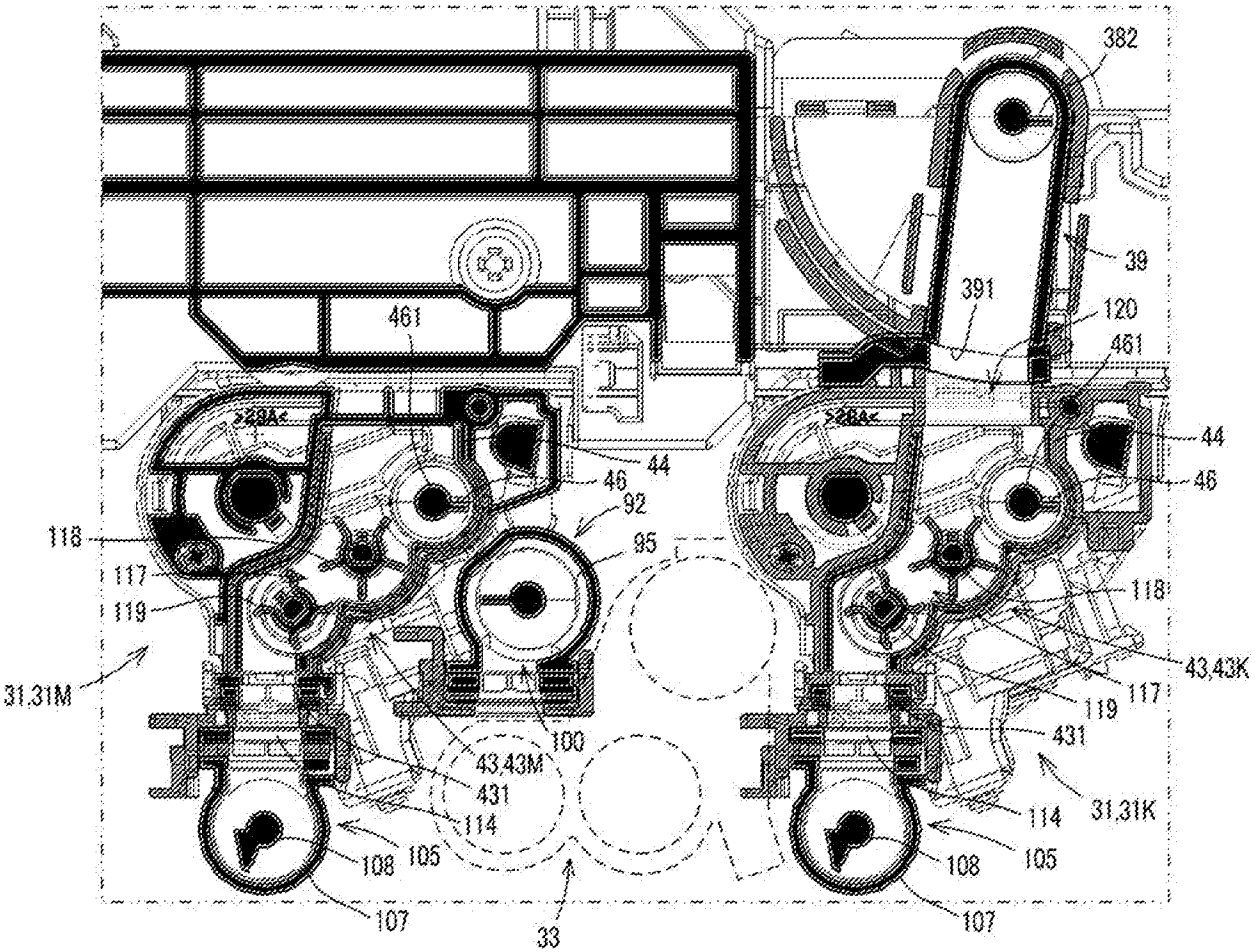

【FIG. 22A】
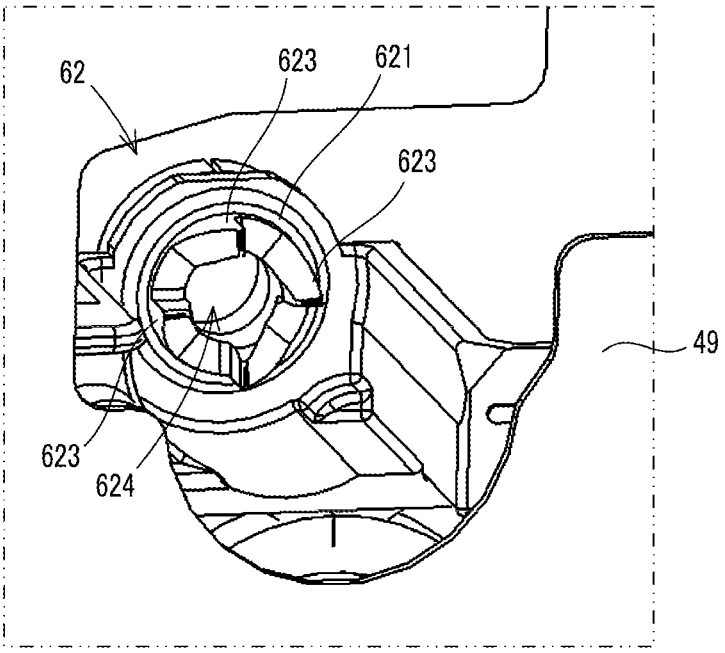
【FIG. 22B】
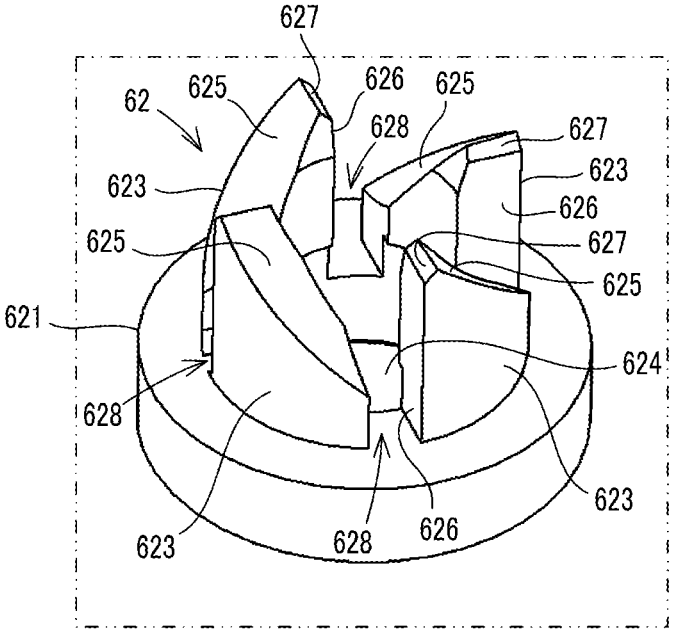

【FIG. 23A】
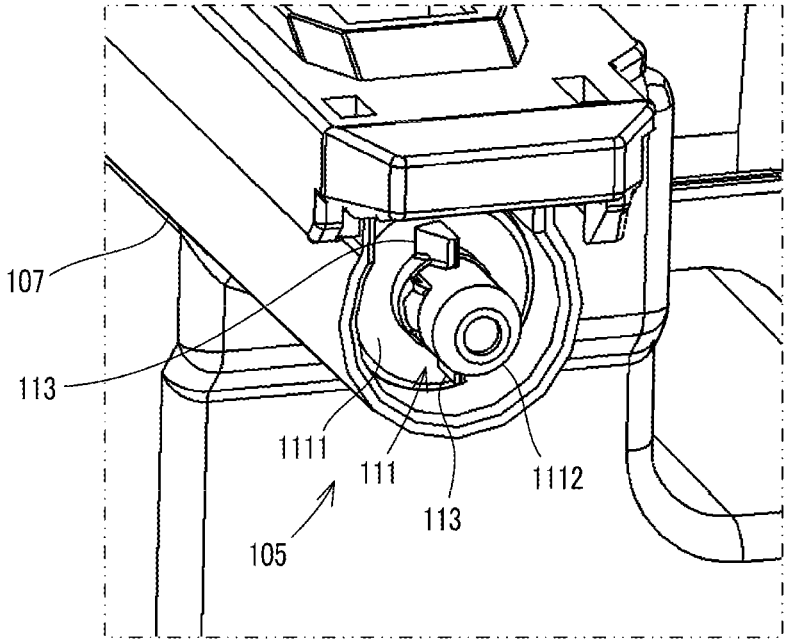
【FIG. 23B】
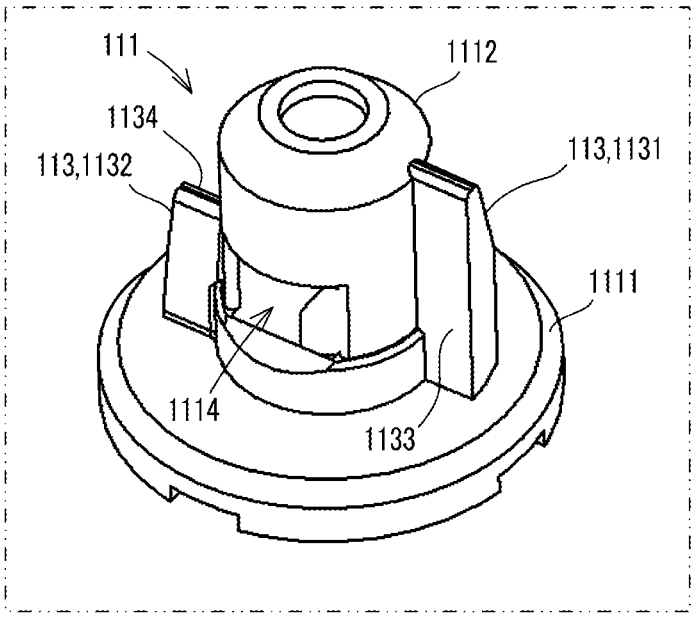

【FIG. 24A】
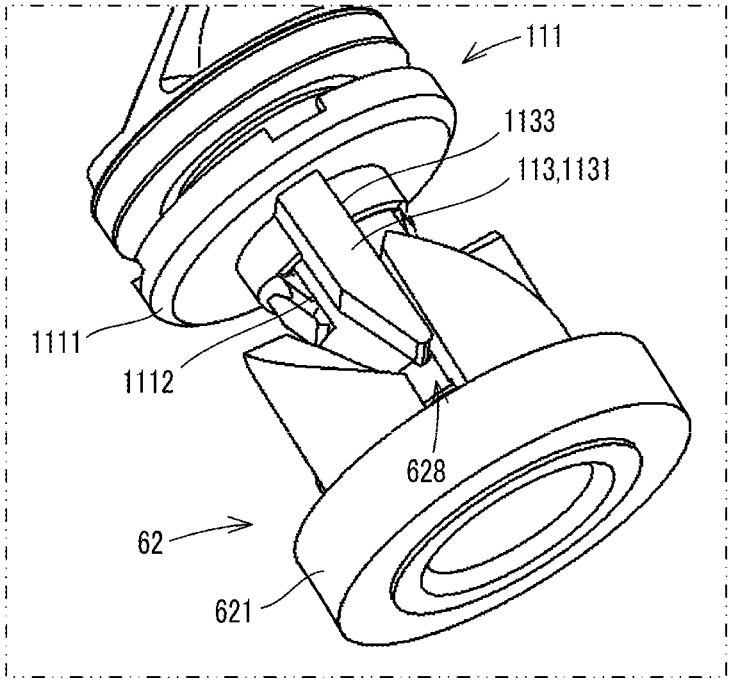
【FIG. 24B】
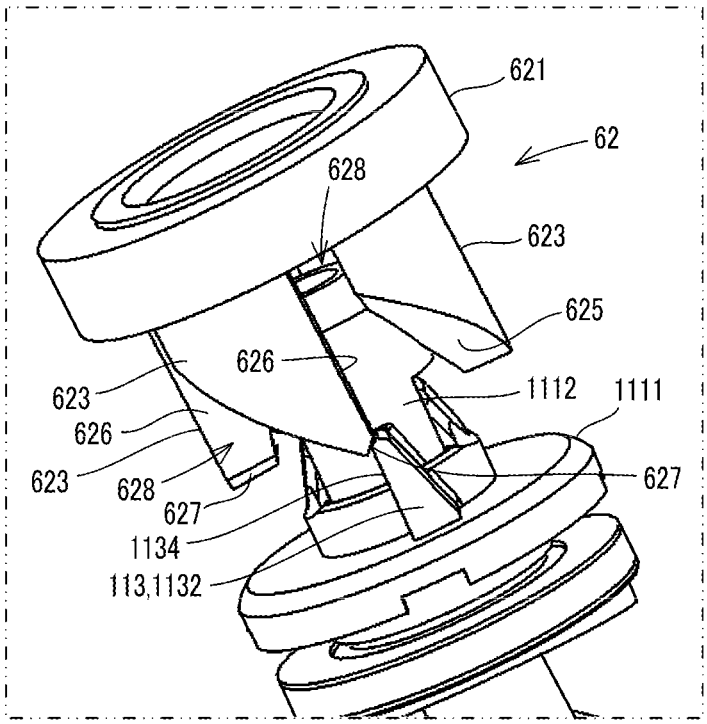

【FIG. 25A】
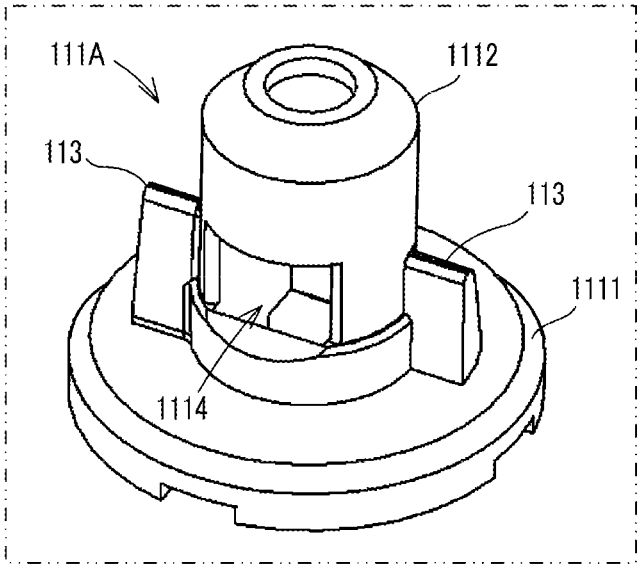
【FIG. 25B】
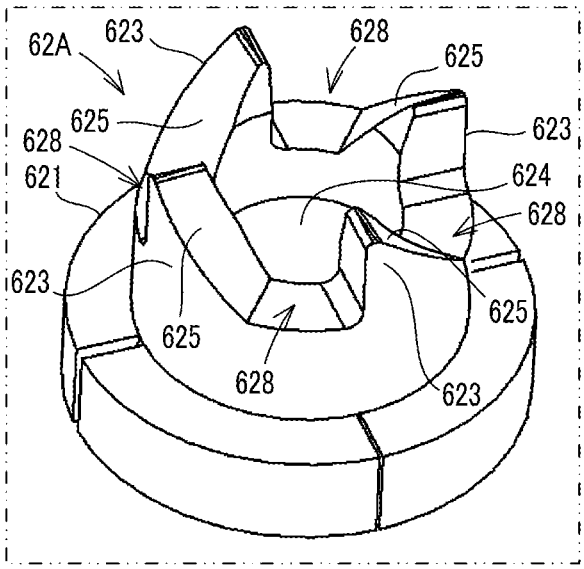

【FIG. 26】
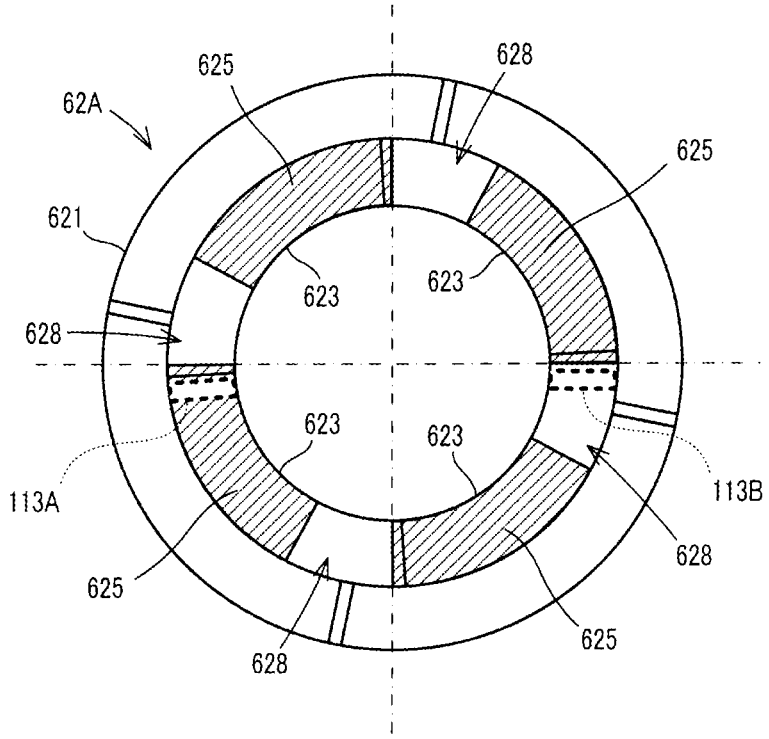

TONER CONTAINER, IMAGE FORMING APPARATUS

INCORPORATION BY REFERENCE

This application is based upon and claims the benefit of priority from the corresponding Japanese Patent Application No. 2016-114510 filed on Jun. 8, 2016, the entire contents of which are incorporated herein by reference.

BACKGROUND

The present disclosure relates to a toner container including a storage portion for storing toner, and relates to an image forming apparatus.

Conventionally, there is known an image forming apparatus that can form an image on a paper sheet by using developer that includes toner. In this type of image forming apparatus, a toner container for supplying toner to a developing device in the image forming apparatus is provided. The toner container is attached to an apparatus main body of the image forming apparatus in a detachable manner. When the toner in the toner container is consumed and the toner container becomes empty, the toner container is removed from the image forming apparatus to be replaced with a new toner container filled with unused toner.

In addition, the toner container is provided with a conveyance member for conveying unused toner stored in the toner container to a developing device included in the image forming apparatus, or a conveyance member for conveying used toner collected from the image forming apparatus to an inside of the toner container. As the conveyance member, there is known a spiral member that has a spiral blade and conveys toner in one direction by being rotated while the blade is in contact with the toner.

SUMMARY

A toner container according to an aspect of the present disclosure includes a container main body, a rotation member, a flat plate-like lid member, a rib member, and a film member. The container main body is elongated and configured to store toner in an inside thereof. The rotation member is rotatably provided in the container main body and extends in a depth direction of the container main body, the depth direction being perpendicular to a longitudinal direction of the container main body. The lid member closes an opening portion formed in one side of a housing of the container main body in the depth direction. The rib member is provided on an inner surface of the lid member in such a way as to be located adjacent to the rotation member with a predetermined gap from the rotation member, and configured to position the lid member with respect to the opening portion. The film member is attached to a wall surface of the housing of the container main body and extends from the wall surface toward the gap such that one surface of the film member contacts the rib member and an opposite surface of the film member contacts an outer circumferential surface of the rotation member.

An image forming apparatus according to another aspect of the present disclosure includes an apparatus main body, a developing device, a drum unit, a cleaning portion, and a toner container. The developing device is included in the apparatus main body. The drum unit includes a rotatable photoconductor drum configured to carry a toner image developed by the developing device. The cleaning portion is included in the drum unit and configured to remove used toner that has remained on the photoconductor drum and convey the removed toner toward one side in an axial direction of a rotation shaft of the photoconductor drum. The toner container is attached, in a detachable manner, to an attachment portion included in the apparatus main body at a position that is more on the one side in the axial direction than the drum unit, and elongated in an up-down direction while the toner container is in an attachment attitude of being attached to the attachment portion. The toner container includes a first toner storage portion, a first rotation member, a second toner storage portion, a second rotation member, a flat plate-like lid member, a rib member, and a film member. The first toner storage portion is configured to store unused toner that is to be supplied to the developing device, and provided in an upper part of the toner container while the toner container is in the attachment attitude. The first rotation member is rotatably provided in the first toner storage portion, extends in a depth direction perpendicular to the up-down direction, and is configured to convey the unused toner to the developing device by being rotated. The second toner storage portion is configured to store the used toner conveyed from the cleaning portion, and provided in a lower part of the toner container below the first toner storage portion while the toner container is in the attachment attitude. A partition wall is provided between the first toner storage portion and the second toner storage portion. The second rotation member is rotatably provided in the second toner storage portion, extends in the depth direction, and is configured to convey the used toner conveyed from the cleaning portion, to the second toner storage portion by being rotated. The lid member closes an opening portion of a first housing of the first toner storage portion and an opening portion of a second housing of the second toner storage portion. The opening portions are formed in one side of the first housing and the second housing in the depth direction. The rib member is provided on an inner surface of the lid member in such a way as to be located adjacent to the second rotation member with a predetermined gap from the second rotation member, and configured to position the lid member with respect to the opening portion of the second housing of the second toner storage portion. The film member is attached to the partition wall and extends from the partition wall toward the gap such that one surface of the film member contacts the rib member and an opposite surface of the film member contacts an outer circumferential surface of the second rotation member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 1 is a perspective view showing a configuration of an image forming apparatus according to an embodiment of the present disclosure.

FIG. 2 is a cross section showing a configuration of the image forming apparatus.

FIG. 3 is a cross section schematically showing an internal structure of an image forming unit included in the image forming apparatus.

FIG. 4 is a diagram showing attachment portions to which toner containers are attached.

FIG. 5 is a perspective view showing configurations of toner containers for magenta and black.

FIG. 6 is a perspective view showing internal structures of the toner containers for magenta and black.

FIG. 7 is a perspective view showing a configuration of a rear side of the toner container for magenta.

FIG. 8 is a perspective view showing a configuration of the rear side of the toner container for magenta.

FIG. 9 is a diagram showing a configuration of a front side of the toner container for magenta.

FIG. 10 is a cross section taken along a X-X line of FIG. 9.

FIG. 11 is a cross section taken along an XI-XI line of FIG. 9.

FIG. 12 is a partial enlarged diagram showing a configuration of the rear side of the toner container for magenta.

FIG. 13 is a partial enlarged diagram showing a configuration of an attachment portion to which the toner container for magenta is attached.

FIG. 14 is a perspective view showing a configuration of a lid member and inner members of the toner container for magenta.

FIG. 15 is a perspective view showing a configuration of the lid member and inner members of the toner container for magenta.

FIG. 16 is a diagram showing a configuration of a bearing portion of a stirring member, and is an enlarged view of a main part X1 shown in FIG. 11.

FIG. 17 is a diagram showing a configuration of a bearing portion of a spiral member of a first conveyance portion, and is an enlarged view of a main part X2 shown in FIG. 10.

FIG. 18 is an enlarged view of a gear transmission mechanism.

FIG. 19 is a diagram showing a configuration of a bearing portion of a spiral member of a second conveyance portion, and is an enlarged view of a main part X3 shown in FIG. 11.

FIG. 20A is a cross section taken along an XX-XX line of FIG. 19, and is a schematic diagram for explaining movements of the spiral member and a film member of the second conveyance portion.

FIG. 20B is a cross section taken along the XX-XX line of FIG. 19, and is a schematic diagram for explaining movements of the spiral member and the film member of the second conveyance portion.

FIG. 21 is a cross section showing a structure of a right-end portion of the image forming apparatus.

FIG. 22A is an enlarged view showing a configuration of a peripheral of a second output joint in the attachment portion 58.

FIG. 22B is a perspective view showing a configuration of the second output joint.

FIG. 23A is an enlarged view showing a configuration of a second input portion 111 in a second conveyance portion 105.

FIG. 23B is a perspective view showing a configuration of the second input portion 111.

FIG. 24A is a diagram showing a state where the second output joint is coupled with the second conveyance portion 105 in an inclined state.

FIG. 24B is a diagram showing a state where the second output joint is coupled with the second conveyance portion 105 in an inclined state.

FIG. 25A is a perspective view showing a configuration of a conventional second input portion.

FIG. 25B is a perspective view showing a configuration of a conventional second output joint.

FIG. 26 is a diagram showing a state where the conventional second input portion is coupled with the conventional second output joint.

DETAILED DESCRIPTION

The following describes an embodiment of the present disclosure with reference to the drawings. It should be noted that the following embodiment is an example of a specific embodiment of the present disclosure and should not limit the technical scope of the present disclosure. It is noted that, for the sake of explanation, a vertical direction in an installed state of an image forming apparatus 10 where the image forming apparatus 10 is usable (the state shown in FIG. 1) is defined as an up-down direction D1. In addition, a front-rear direction D2 is defined on a supposition that a side to/from which a sheet feed cassette 22 shown in FIG. 1 is inserted and removed in the installed state is a front side. Furthermore, a left-right direction D3 is defined based on the front side of the image forming apparatus 10 in the installed state.

The image forming apparatus 10 according to the present embodiment has at least a print function. The image forming apparatus 10 is, for example, a tandem-type color printer.

As shown in FIG. 1 and FIG. 2, the image forming apparatus 10 includes a housing 11 (an example of the apparatus main body). The housing 11 has an approximately parallelepiped shape as a whole. Some of the components constituting the image forming apparatus 10 are stored in the housing 11. It is noted that FIG. 1 shows a state where a cover covering the right side of the housing 11 has been removed.

As shown in FIG. 2, the image forming apparatus 10 includes a plurality of image forming units 15 (15Y, 15C, 15M, and 15K), an intermediate transfer unit 16, a laser scanning device 17, a primary transfer roller 18, a secondary transfer roller 19, a fixing device 20, a sheet tray 21, the sheet feed cassette 22, a conveyance path 24, and a control board 26 configured to control the portions of the image forming apparatus 10. In addition, the image forming apparatus 10 includes toner containers 3 (see FIG. 1) that have been attached to the inside of the housing 11 in a detachable manner. In the present embodiment, the image forming apparatus 10 includes four image forming units 15.

FIG. 3 is a cross-sectional view of a central portion of an image forming unit 15. The image forming unit 15 forms a toner image by the electrophotography. As shown in FIG. 3, each of the image forming units 15 includes a drum unit 31, a charging device 32, and a developing device 33.

As shown in FIG. 2, the image forming units 15 are arranged in alignment along the front-rear direction D2 in the housing 11, and form a color image based on the so-called tandem system. Specifically, the image forming unit 15Y is configured to form a toner image of yellow. In addition, the image forming units 15C, 15M and 15K are configured to form toner images of cyan, magenta and black, respectively. The image forming units 15Y for yellow, 15C for cyan, 15M for magenta, and 15K for black are arranged in alignment in the stated order from the downstream side in the running direction (the direction indicated by the arrow D10) of a transfer belt 35 of the intermediate transfer unit 16.

The drum unit 31 includes a photoconductor drum 41, a drum cleaning device 42 (an example of the drum cleaning portion), a discharge guide portion 43 (see FIG. 21), and a housing 44 that supports these components. The housing 44 is elongated in the left-right direction D3. The photoconductor drum 41 has a cylindrical shape and carries a toner image developed by the developing device 33. The photoconductor drum 41 is rotatably supported by the housing 44.

In each of the image forming units 15, the charging device 32 uniformly charges the photoconductor drum 41 to a certain potential. Subsequently, the laser scanning device 17 irradiates a laser beam on the surface of the photoconductor drum 41 based on the image data. In this processing, electrostatic latent images are formed on the surfaces of the photoconductor drums 41, respectively. The electrostatic latent images are developed (visualized) as toner images by the developing devices 33, respectively. The toner images of respective colors formed on the surfaces of the photoconductor drums 41 are transferred to the transfer belt 35 by the primary transfer roller 18 such that the toner images are overlaid with each other in sequence. Next, the color image on the transfer belt 35 is transferred by the secondary transfer roller 19 to a print sheet. The color image transferred to the print sheet is fixed to the print sheet by the fixing device 20, and thereafter, the print sheet is discharged from a sheet discharge port 28 to the sheet tray 21.

The drum cleaning device 42 is configured to remove toner that has remained on the photoconductor drum 41 after the transfer. The drum cleaning device 42 is disposed on the rear side of the photoconductor drum 41. The drum cleaning device 42 is provided for each photoconductor drum 41. The drum cleaning device 42 includes a cleaning blade 45 that is a cleaning member, and a spiral member 46. The cleaning blade 45 and the spiral member 46 are elongated in the left-right direction D3. The cleaning blade 45 and the spiral member 46 are supported by the housing 44. The cleaning blade 45 has approximately the same length as the photoconductor drum 41. The tip of the cleaning blade 45 is disposed so as to be in contact with or close to the surface of the photoconductor drum 41. The spiral member 46 is a toner conveyance member having a spiral blade around a shaft. The spiral member 46 is rotatably supported in the housing 44.

The spiral member 46 is rotated when a rotational driving force is input to its shaft. While the photoconductor drum 41 is rotated, the cleaning blade 45 removes toner that has remained on the surface of the photoconductor drum 41 after the transfer by the primary transfer roller 18. The removed toner is to be discarded later, and thus called waste toner in general. The waste toner is conveyed toward a certain direction by the rotating spiral member 46. Specifically, the waste toner is conveyed toward one side (in the present embodiment, the right side) in the axial direction (longitudinal direction) of the photoconductor drum 41.

As shown in FIG. 21, the discharge guide portion 43 is disposed at the right end of the housing 44. The waste toner is guided downward by the discharge guide portion 43, passes through a discharge port 431 (see FIG. 21) that is described below, and is discharged to a lower storage portion 72 of the toner container 3. It is noted that the discharge guide portion 43 is described below.

As shown in FIG. 3, the developing device 33 includes a housing 50, a first stirring member 52, a second stirring member 53, and a developing roller 54. Toner (developer) is stored in a bottom portion of the housing 50 and the toner is conveyed while being stirred by the first stirring member 52 and the second stirring member 53. A supply port 56 is formed in a wall 51 of the housing 50 that is located above the first stirring member 52. The supply port 56 is formed at the right end of the wall 51. The toner discharged from the toner container 3 is supplied from the supply port 56 into the housing 50. The developing roller 54 draws up the toner from the second stirring member 53 by the magnetic pole embedded therein, and carries the toner on its circumferential surface. The toner held on the developing roller 54 is caused to adhere to the electrostatic latent image on the photoconductor drum 41 by the potential difference applied to between the developing roller 54 and the photoconductor drum 41.

As shown in FIG. 1, a plurality of toner containers 3 (3Y, 3C, 3M and 3K) are attached to the inside of the housing 11. Specifically, the four toner containers 3 are respectively attached to attachment portions 58 (see FIG. 4) provided in the inside of the housing 11. In addition, in the present embodiment, a plurality of toner containers 3 are attached in a state of being aligned along the front-rear direction D2, and a toner container 3K for black is disposed at the rear-most position.

Each of the toner containers 3 includes an upper storage portion 71 (an example of the first toner storage portion) and a lower storage portion 72 (an example of the second toner storage portion). The upper storage portion 71 includes, inside thereof, a storage space 85 (see FIG. 6) for storing toner, and unused toner for supply is stored in the storage space 85. The lower storage portion 72 includes, inside thereof, a storage space 86 (see FIG. 6) for storing toner, and the waste toner discharged from the drum cleaning device 42 is stored in the storage space 86. In the state where the toner containers 3 are respectively attached to the attachment portions 58, the unused toner is supplied to the insides of the developing devices 33 from the upper storage portions 71 of the toner containers 3. In addition, waste toner discharged from the drum cleaning devices 42 passes through the discharge guide portions 43 (see FIG. 21), and is stored in the lower storage portions 72 of the toner containers 3. As shown in FIG. 1, in the present embodiment, the four toner containers 3 are located at the right side of the image forming units 15 inside a right-side cover (not shown) of the housing 11. The toner containers 3 are arranged on the right side of the housing 11 in alignment along the front-rear direction D2. The toner containers 3 are described in detail below.

As shown in FIG. 2, the intermediate transfer unit 16 is provided above the four image forming units 15. More specifically, the intermediate transfer unit 16 is provided above the photoconductor drums 41. The intermediate transfer unit 16 includes the transfer belt 35, a driving roller 36, a driven roller 37, a belt cleaning device 38 (an example of the belt cleaning portion), and a relay guide portion 39 (see FIG. 21). It is noted that the primary transfer roller 18 is supported by a frame (not shown) of the intermediate transfer unit 16.

The transfer belt 5, an annular belt member, is suspended between the driving roller 36 and the driven roller 37 so as to extend in the front-rear direction D2. A plurality of drum units 31 are arranged in alignment in the front-rear direction D2 along the transfer belt 35. The transfer belt 35 holds, on its surface, toner images primarily transferred from the photoconductor drums 41. When the transfer belt 35 is rotationally driven and moves in a direction indicated by the arrow D10, the toner images of respective colors carried by the photoconductor drums 41 are transferred to the transfer belt 35 such that the toner images are overlaid with each other in sequence.

The belt cleaning device 38 is disposed in the vicinity of the fixing device 20. Specifically, the belt cleaning device 38 is provided above the transfer belt 35 in the rear side of the housing 11. Below the belt cleaning device 38, the image forming unit 15K, which is an image forming unit 4 for black, is disposed. That is, the belt cleaning device 38 is located closest to the image forming unit 15K for black among the plurality of image forming units 4.

The belt cleaning device 38 is configured to remove the waste toner that has remained on the surface of the transfer belt 35, and convey the removed waste toner toward the lower storage portion 72 of the toner container 3K. The belt cleaning device 38 includes a cleaning roller 381 that is elongated in the left-right direction D3, a spiral member 382 as a conveyance member for conveying the waste toner, and a housing 383 for storing these components (see FIG. 2). The cleaning roller 381 is configured to remove the waste toner from the surface of the transfer belt 35 by rotating while in contact with the surface of the transfer belt 35. The used toner thus removed (hereinafter referred to as "waste toner") is conveyed in a certain direction by the spiral member 382 as it rotates. Specifically, the waste toner is conveyed toward one side in the width direction (a direction that matches the left-right direction D3) of the transfer belt 35 (in the present embodiment, conveyed toward the right side).

As shown in FIG. 21, the relay guide portion 39 is provided at the right end of the housing 383. The waste toner is guided downward by the relay guide portion 39, passes through a discharge guide portion 43K of a drum unit 31K disposed at the rear-most position, and is conveyed to the lower storage portion 72 of the toner container 3K. It is noted that the relay guide portion 39 is described below.

FIG. 21 is a partial enlarged diagram showing a cross-sectional structure of a right-end portion of the drum units 31 of the image forming units 15. FIG. 21 shows cross-sectional structures of the drum unit 31M for magenta and the drum unit 31K for black. For the sake of explanation, in FIG. 21, a developing device 33 corresponding to the drum unit 31K is represented by a dotted line. As shown in FIG. 21, a discharge guide portion 43M is provided at the right end of the housing 44 of the drum unit 31M. That is, the discharge guide portion 43M is provided in the drum unit 31M. It is noted that a discharge guide portion 43 having the same structure as the discharge guide portion 43M is provided in each of the drum units 31 for yellow and cyan.

The discharge guide portion 43M guides the waste toner that has been removed by the drum cleaning device 42 in the drum unit 31M and conveyed to the right end of the housing 44, to an inlet 114 of the lower storage portion 72 of the toner container 3M. An inner space of the discharge guide portion 43M is a passage 117 in which the waste toner passes. The discharge guide portion 43M extends diagonally downward from above, and the discharge port 431 connected to the inlet 114 is formed at a lower end of the discharge guide portion 43M.

In the passage 117, a right end portion 461 of the spiral member 46 is disposed. The end portion 461 is rotatably supported by the discharge guide portion 43M. When a rotational driving force is transmitted to the end portion 461, the spiral member 46 rotates, and the waste toner is conveyed to the passage 117 of the discharge guide portion 43M.

In the passage 117, two paddle portions 118 and 119 are provided in a region from the end portion 461 to the discharge port 431. The rotation shaft of each of the paddle portions 118 and 119 is rotatably supported by the discharge guide portion 43M. The rotational driving force of the spiral member 46 is transmitted to the paddle portions 118 and 119 via a gear transmission mechanism (not shown). When the spiral member 46 is rotated, its rotational driving force is transmitted to the paddle portions 118 and 119 via the gear transmission mechanism, and the paddle portions 118 and 119 are rotated. When the paddle portions 118 and 119 rotate, the waste toner that has been conveyed to the passage 117 is conveyed in the passage 117 to the discharge port 431 by the paddle portions 118 and 119, is further passed through the inlet 114 and a first conveyance guide portion 94 (an example of the first guide portion) of the toner container 3M, and guided into the lower storage portion 72 of the toner container 3M.

As shown in FIG. 21, a discharge guide portion 43K is provided at the right end of the housing 44 of the drum unit 31K. That is, the discharge guide portion 43K is provided in the drum unit 31K. The discharge guide portion 43K guides the waste toner that has been removed by the drum cleaning device 42 in the drum unit 31K and conveyed to the right end of the housing 44, to the inlet 114 of the lower storage portion 72 of the toner container 3K. The discharge guide portion 43K and the discharge guide portion 43M have some components in common. As a result, the components common to these portions are assigned the same reference signs, and description thereof is omitted.

The discharge guide portion 43K differs from the discharge guide portion 43M in that a receiving port 120 is formed at the top of the discharge guide portion 43K. The receiving port 120 is an opening from which the waste toner discharged from the belt cleaning device 38 is received. The receiving port 120 is connected to a discharge port 391 of the relay guide portion 39 that is described below. The waste toner that has entered the receiving port 120 is guided to the inlet 114 of the lower storage portion 72 of the toner container 3K by the discharge guide portion 43K, together with the waste toner discharged from the drum cleaning device 42.

As shown in FIG. 21, the relay guide portion 39 is provided at the right end of the belt cleaning device 38. The relay guide portion 39 guides the waste toner that has been conveyed to the right end of the housing 383 through the belt cleaning device 38 by the spiral member 382, to the discharge guide portion 43K. The discharge port 391 is formed in a lower portion of the relay guide portion 39, and the discharge port 391 is connected to the receiving port 120 of the discharge guide portion 43K. With this configuration, the waste toner discharged from the belt cleaning device 38 passes through the relay guide portion 39 and moves downward, and is guided through the discharge port 391 to the receiving port 120. The waste toner guided to the receiving port 120 passes through the discharge guide portion 43K, is conveyed further downward by the paddle portions 118 and 119, passes through the discharge port 431, the inlet 114, and a second conveyance guide portion 107 (an example of the second guide portion) of the toner container 3K, and is guided into the lower storage portion 72 of the toner container 3K.

As shown in FIG. 4, four attachment portions 58 for supporting the toner containers 3 in a detachable manner are provided at the right end of the housing 11. The attachment portions 58 are fixed to a support plate 49 provided at the right end of the housing 11. Each attachment portion 58 includes a bracket 59 for supporting a corresponding toner container 3. The toner containers 3 are supported by corresponding brackets 59 in a detachable manner.

In the following, the configuration of the toner container 3M for magenta is described. FIG. 5 and FIG. 6 show the toner container 3M and the toner container 3K disposed next to the toner container 3M.

The toner container 3K is larger in outer shape and capacity than the toner container 3M since the toner container 3K stores black toner that is used much, but except for this, they have approximately the same configuration. As a result, components of the toner container 3K that are the same as those of the toner container 3M are assigned the same reference signs, and description thereof is omitted. In addition, the toner containers 3Y and 3C have the same configuration as the toner container 3M, thus description thereof is omitted.

It is noted that the drawings show the up-down direction D1, the front-rear direction D2 and the left-right direction D3 based on an attachment attitude of the toner containers 3M and 3K when they are attached to the attachment portions 58 (see FIG. 4). In the following, with respect to the toner containers 3M and 3K in the attachment attitude, the up-down direction D1 is defined as a height direction D11 of the toner containers 3M and 3K, the front-rear direction D2 is defined as a width direction D12 of the toner containers 3M and 3K, and the left-right direction D3 is defined as a depth direction D13 of the toner containers 3M and 3K.

As shown in FIG. 5 and FIG. 6, the toner container 3M includes a container main body 75. The container main body 75 is a resin product formed by injection molding a synthetic resin. The container main body 75 is elongated in the height direction D11, broad in the width direction D12, and shallow in the depth direction D13.

The container main body 75 includes an upper case 78 (an example of the first housing) formed in the upper side thereof, a lower case 79 (an example of the second housing) formed in the lower side thereof, and a lid member 76 (an example of the lid member). That is, the upper case 78 is formed in one side (upper side) of the container main body 75 in the height direction D11 (longitudinal direction), and the lower case 79 is formed in the other side (lower side) of the container main body 75 in the height direction D11 (longitudinal direction). The upper case 78 and the lower case 79 are integrally formed as the container main body 75. In the upper case 78, the storage space 85 for storing the unused toner is provided as a sectioned space. That is, the storage space 85 in the upper storage portion 71 is sectioned by the upper case 78. In addition, in the lower case 79, the storage space 86 for storing the waste toner is provided as a sectioned space. That is, the storage space 86 in the lower storage portion 72 is sectioned by the lower case 79.

The upper case 78 and the lower case 79 are separated from each other in the up-down direction D1, and a gap 88 (see FIG. 7) having a predetermined distance is formed between the upper case 78 and the lower case 79. Specifically, as shown in FIG. 7 and FIG. 12, the upper case 78 includes a bottom wall 782 that constitutes the bottom wall surface thereof and is formed in an arc shape, and the lower case 79 includes a top wall 792 that constitutes the top wall surface thereof. The gap 88 is formed between the bottom wall 782 and the top wall 792. Here, the bottom wall 782 and the top wall 792 are an example of the pair of walls that are separated from each other in the height direction D11.

An opening portion 81 is formed in the right side surface of the upper case 78, and an opening portion 82 is formed in the right side surface of the lower case 79. The opening portions 81 and 82 are formed on the same plane. A flange 83 is formed along opening edges of the opening portions 81 and 82. The flange 83 is formed in the shape of a plate having a thickness in the depth direction D13. The flange 83 includes a peripheral flange 831 and a central flange 832 (an example of the coupling member and the common flange). The peripheral flange 831 is formed around the outer peripheral edge of the right side surface of the container main body 75. The central flange 832 is, as shown in FIG. 12, formed at a position corresponding to the gap 88 so as to couple the bottom wall 782 of the upper case 78 with the top wall 792 of the lower case 79. More specifically, the central flange 832 is continued from the lower edge of the opening portion 81 to the upper edge of the opening portion 82. In other words, the central flange 832 is a flange common to the opening portion 81 and the opening portion 82. In the present embodiment, the bottom wall 782 and the top wall 792 extend from the central flange 832 in the depth direction D13.

The lid member 76 is a resin product formed by injection molding a synthetic resin. As shown in FIG. 5, the lid member 76 covers the opening portion 81 and the opening portion 82. The lid member 76 is a flat plate-like member and is formed in the shape that matches the peripheral shape of the flange 83. In a state where an outer peripheral edge 761 of the lid member 76 is aligned with the flange 83, the outer peripheral edge 761 and the flange 83 are welded.

FIG. 14 and FIG. 15 are perspective views showing a configuration on the side of the inner surface 762 of the lid member 76. FIG. 14 and FIG. 15 show attitudes of the stirring member 91 and the spiral member 95 when they are supported by the container main body 75. As shown in FIG. 14 and FIG. 15, a plurality of ribs 77 are provided on the inner surface 762 of the lid member 76. The ribs 77 are integrally formed with the lid member. The plurality of ribs 77 are used for positioning of the lid member 76 to the upper case 78 and the lower case 79, and are provided in the vicinity of the outer peripheral edge 761 of the lid member 76. During a process of fitting the outer peripheral edge 761 of the lid member 76 to the flange 83, the ribs 77 get into the inside of the opening portions 81 and 82. By this way, the ribs 77 guide the lid member 76 with respect to the opening portions 81 and 82 so that the outer peripheral edge 761 of the lid member 76 is exactly fitted to the flange 83.

As shown in FIG. 15, a rib 771 (an example of the rib member), which is one of the plurality of ribs 77, projects longer than the other ribs 77 from the inner surface 762. The rib 771 contacts an inner surface of the top wall 792 (see FIG. 12) of the lower case 79, and guides the lid member 76 with respect to the opening portions 81 and 82. Here, the top wall 792 is an example of the partition wall provided between the upper storage portion 71 and the lower storage portion 72. The rib 771 includes a base plate 7711 and a pair of side plates 7712 and 7713, wherein the base plate 7711 is parallel to the width direction D12, and the side plates 7712 and 7713 extend downward from opposite ends of the base plate 7711 in the width direction D12. In the width direction D12, the side plate 7712 is located on the front side, and the side plate 7713 is located on the rear side. In addition, the rib 771 is disposed in proximity to a boss 185 provided on the inner surface 762 of the lid member 76, wherein the boss 185 is described below. Specifically, the rib 771 is located in the diagonally upper front of the boss 185 with a small gap therebetween. The boss 185 rotatably supports an end portion 1091 of a spiral member 108 on the lid member 76 side, wherein the spiral member 108 is described below. That is, the rib 771 is provided adjacent to the spiral member 108.

With the opening portion 81 and the opening portion 82 being closed by one lid member 76, the upper storage portion 71 having the storage space 85 and the lower storage portion 72 having the storage space 86 are provided. In this way, since the upper storage portion 71 and the lower storage portion 72 are coupled with each other by the central flange 832 and the lid member 76, in the toner container 3M, a portion around the gap 88 is smaller in strength than the other portions. As a result, the toner container 3M can be easily bent at the vicinity of the gap 88 in the width direction D12 and in the depth direction D13, and can be easily bent in the rotation direction around the height direction D11 as the axis of rotation.

As shown in FIG. 7 and FIG. 12, a plate-like reinforcing rib 751 is disposed between the bottom wall 782 of the upper case 78 and the top wall 792 of the lower case 79. The reinforcing rib 751 extends in the depth direction D13 vertically from the central flange 832. As shown in FIG. 12, the reinforcing rib 751, coupled with the bottom wall 782 and the top wall 792, is a plate-like member having a thickness in the width direction D12. As shown in FIG. 7, the left-end surface of the reinforcing rib 751 is inclined diagonally upward left from the top wall 792 to the bottom wall 782, and more specifically, inclined in a curved shape. With the provision of the reinforcing rib 751 as such, the strength at the vicinity of the gap 88 between the upper storage portion 71 and the lower storage portion 72 is reinforced. As a result, the toner container 3M is prevented from being excessively bent at the vicinity of the gap 88, in particular, prevented from being excessively bent in the depth direction D13.

As shown in FIG. 8 and FIG. 11, the lower storage portion 72 of the toner container 3M is larger in size in the depth direction D13 than the upper storage portion 71. That is, the size in the depth direction D13 of the lower storage portion 72 of the toner container 3M is larger than that of the upper storage portion 71. In addition, the size in the height direction D11 of the upper storage portion 71 is larger than that of the lower storage portion 72, and the upper storage portion 71 and the lower storage portion 72 have approximately the same size in the width direction D12. In the configuration where the upper storage portion 71 and the lower storage portion 72 are separate in the up-down direction D1, there may be a case where each of the upper storage portion 71 and the lower storage portion 72 cannot secure an enough capacity for storing toner. However, with the above-described configuration where the upper storage portion 71 and the lower storage portion 72 have different sizes in the height direction D11 and the depth direction D13, it is possible to secure an enough capacity for each of the upper storage portion 71 and the lower storage portion 72 in spite of various constraints in the attachment to the attachment portion 58.

As shown in FIG. 6, the upper storage portion 71 includes a stirring member 91 (an example of the third rotation member) and a first conveyance portion 92. Specifically, a paddle-like stirring member 91 is provided in the upper storage space 85. The stirring member 91 is supported by the upper case 78 so as to be rotatable in the storage space 85. In addition, the first conveyance portion 92 for conveying toner to the developing device 33 is provided in the storage space 85.

The stirring member 91 is a rotation member rotatably supported by the upper storage portion 71. By rotating upon receiving a driving force from outside, the stirring member 91 stirs the unused toner stored in the upper storage portion 71. As shown in FIG. 11, FIG. 14, and FIG. 15, the stirring member 91 is provided in parallel to a spiral member 95 that is described below. The stirring member 91 roughly includes a rotation shaft member 911 (an example of the third rotation shaft and the stirring rotation shaft), and a film-like paddle portion 912 (an example of the film member).

As shown in FIG. 11, the rotation shaft member 911 is rotatably provided in the storage space 85 of the upper storage portion 71. The rotation shaft member 911 is a shaft member elongated in the depth direction D13. An end portion 161 (an example of the third end portion) of the rotation shaft member 911 located in one side in the axial direction (the lid member 76 side) is rotatably supported by the inner surface 762 of the lid member 76 that constitutes a right wall surface of the upper storage portion 71. Specifically, a bearing portion 171 (an example of the third bearing portion, see FIG. 16) is integrally formed with the inner surface 762 of the lid member 76, and the end portion 161 is rotatably supported by the bearing portion 171. In addition, an end portion 162 of the rotation shaft member 911 located in the other side (the opposite side) in the axial direction is rotatably supported by an inner surface 785 of a left side wall of the upper case 78 (the attachment portion 58 side). Specifically, a bearing portion 172 is integrally formed with the inner surface 785 of the upper case 78, and the end portion 162 is rotatably supported by the bearing portion 172. By this way, the rotation shaft member 911 is rotatably supported in the storage space 85.

As shown in FIG. 14 and FIG. 15, the rotation shaft member 911 includes a base portion 160 as a shaft main body. The base portion 160 is a plate-like member extending in the depth direction D13. The end portion 161 is provided on the lid member 76 side of the base portion 160, and the end portion 162 is provided on the opposite side of the base portion 160. The rotation shaft member 911 is a resin product in which the base portion 160, the end portion 161 and the end portion 162 are integrally formed.

FIG. 16 is an enlarged view of a main part X1 that is enclosed by a two-dot chain line in FIG. 11. As shown in FIG. 16, the end portion 161 is an annular concave recess portion recessed from an end surface on the lid member 76 side to the opposite side (the inner surface 785 side) along the axial direction of the rotation shaft member 911. Hereinafter, the end portion 161 is referred to as a concave recess portion 161. An inner surface of a concave portion 1611 of the concave recess portion 161 is formed in an annular shape. In the present embodiment, the base portion 160 is joined to an outer peripheral edge portion of the concave recess portion 161. An engagement opening 1631 (an example of the second engagement opening) is formed in a bottom portion 163 of the concave recess portion 161, wherein the engagement opening 1631 penetrates in the axial direction of the rotation shaft member 911. The engagement opening 1631 is formed in a rectangular shape, for example.

The bearing portion 171 includes a boss 173 (an example of the second boss) projecting vertically from the inner surface 762 of the lid member 76. The boss 173 has a cylindrical shape. The boss 173 is inserted in the concave portion 1611 of the concave recess portion 161, thereby the concave recess portion 161 is rotatably supported by the boss 173. It is noted that a through hole 174 (an example of the second through hole) is formed at the center of a projection end of the boss 173, wherein a second coupling portion 1922 of a second transmission portion 192 described below can be inserted through the through hole 174.

As shown in FIG. 11, the end portion 162 is a disk-shaped member. The end portion 162 is joined to the base portion 160 in a vertical direction thereto in such a way as to face the concave recess portion 161. A circular shaft hole 1621 (see FIG. 14) is formed at the center of the end portion 162. The bearing portion 172 is a boss projecting from the inner surface 785 of a left side wall of the upper case 78 (the attachment portion 58 side). The bearing portion 172 has a cylindrical shape. The bearing portion 172 is inserted in the shaft hole 1621, thereby the end portion 162 is rotatably supported by the bearing portion 172.

As shown in FIG. 14 and FIG. 15, the base portion 160 includes two support pieces 165. The support pieces 165 are provided to support the paddle portion 912. The two support pieces 165 are disposed on the base portion 160 with an interval in the axial direction. The support pieces 165 are plate pieces (support pieces) disposed to form a small gap between itself and a side surface of the base portion 160, and an edge of the paddle portion 912 is inserted in the small gap and fixed there.

The paddle portion 912 is a film member formed as a thin film. The paddle portion 912 is made of an elastic, synthetic resin material, such as a polyester or a PET (polyethylene terephthalate) resin. When the stirring member 91 is rotated, the paddle portion 912 contacts and stirs the unused toner stored in the upper storage portion 71. The paddle portion 912 includes a main body portion 9121 and a projection portion 9122, wherein the main body portion 9121 is attached to the support pieces 165 of the base portion 160, and the projection portion 9122 projects from an end of the main body portion 9121 on the lid member 76 side toward the inner surface 762. Specifically, the projection portion 9122 extends from a peripheral edge of a bottom portion 1885 of a second storage portion 1882 described below to the inner surface 762 in such a way as to avoid a step between the inner surface 762 and the bottom portion 1885.

With the above-described configuration of the stirring member 91, when a rotational driving force is input to the rotation shaft member 911, the stirring member 91 is rotated in one direction in the storage space 85. In the present embodiment, the stirring member 91 is rotated in a rotation direction D31 shown in FIG. 14. This allows the paddle portion 912 to stir the unused toner in the storage space 85. In particular, since the above-described projection portion 9122 is provided in the paddle portion 912, unused toner that is present in a region from the bottom portion 1885 of the second storage portion 1882 described below to the inner surface 762 is stirred by the projection portion 9122 in a reliable manner.

As shown in FIG. 7 and FIG. 8, the first conveyance portion 92 includes a first conveyance guide portion 94 and a spiral member 95, wherein the first conveyance guide portion 94 is cylindrical and extends outward from a wall surface 781 (an example of the facing surface) of the left side of the upper case 78, and the spiral member 95 (an example of the first rotation member and the second conveyance member, see FIG. 10) is provided in the inside of the first conveyance guide portion 94. The first conveyance guide portion 94 is integrally formed with the upper case 78 in the shape of a cylinder whose center is the same as the rotation center of the spiral member 95. Here, the wall surface 781 is located in one side of the toner container 3M with respect to the attachment portion 58 in the depth direction D13, and is a surface that faces the attachment portion 58 when the toner container 3M is attached to the attachment portion 58. It is noted that the depth direction D13 matches the direction in which the toner container 3M is attached to and detached from the attachment portion 58.

The spiral member 95 is rotatably provided in the upper storage portion 71, and as shown in FIG. 10, extends in the depth direction D13 that is perpendicular to the height direction D11. The spiral member 95 is a conveyance member that conveys the unused toner in the storage space 85 toward the attachment portion 58 (see FIG. 4) through the inside of the first conveyance guide portion 94. In addition, the first conveyance guide portion 94 is a guide member that guides the unused toner conveyed by the spiral member 95 to the developing device 33.

As shown in FIG. 10, the spiral member 95 includes blades 97 of a spiral shape around a rotation shaft 96. An end portion 961 (an example of the first end portion) of the rotation shaft 96 of the spiral member 95 on the lid member 76 side is rotatably supported by a bearing portion 99 (an example of the first bearing portion) that is integrally formed with an inner surface 762 of the lid member 76. In addition, in a state where the spiral member 95 is inserted in the first conveyance guide portion 94, the opposite end of the rotation shaft 96 is rotatably supported by the first conveyance guide portion 94. Specifically, a first input portion 98 (an example of the first drive input portion and the second input joint) is integrally formed with an end portion 962 that is the opposite end of the rotation shaft 96, wherein the first input portion 98 receives a rotational driving force input from outside. In addition, a through hole 941 is formed in the tip of the first conveyance guide portion 94. In the state where the first input portion 98 projects from the through hole 941 to the outside, the end portion 962 is rotatably supported by the through hole 941.

In the following, the support structure of the end portion 961 of the spiral member 95 is described concretely with reference to FIG. 17. Here, FIG. 17 is an enlarged view of a main part X2 that is enclosed by a two-dot chain line in FIG. 10.

As shown in FIG. 17, the end portion 961 of the rotation shaft 96 (an example of the first rotation shaft) includes an inner hole 178 that extends along the axial direction from an end surface of the rotation shaft 96 on the lid member 76 side toward the opposite side. That is, the end portion 961 is a cylinder portion formed in a cylindrical shape so as to have the inner hole 178 in its inside. The inner hole 178 is formed in a size by which a first coupling portion 1912 of a first transmission portion 191 described below can be inserted therethrough. On an end surface of the end portion 961 on the lid member 76 side, an arc-shaped support portion 179 whose outer diameter is larger than the inner hole 178 is formed. It is noted that an engagement opening 9611 (an example of the first engagement opening) is formed on an outer circumferential surface of the end portion 961, wherein a first engaging portion 197 described below is engaged with the engagement opening 9611 when the first coupling portion 1912 described below is inserted through the inner hole 178. The engagement opening 9611 is inserted through the inner hole 178 of the end portion 961.

In addition, as described above, the bearing portion 99 is provided on the inner surface 762 of the lid member 76. The bearing portion 99 includes a boss 180 (an example of the first boss) that projects vertically from the inner surface 762 of the lid member 76. The boss 180 is inserted in the support portion 179 of the end portion 961, thereby the end portion 961 is supported by the boss 180. It is noted that a through hole 181 (an example of the first through hole) is formed at the center of a projection end of the boss 180, wherein the first coupling portion 1912 of the first transmission portion 191 described below can be inserted through the through hole 181.

With the above-described configuration of the bearing portion 99 and the end portion 961, when a rotational driving force is input to the rotation shaft 96 of the spiral member 95, the spiral member 95 is rotated in one direction in the storage space 85. In the present embodiment, when a rotational driving force is input to the first input portion 98, the spiral member 95 is rotated in a rotation direction D30 shown in FIG. 12. This allows the unused toner in the storage space 85 to be conveyed in the first conveyance guide portion 94 toward the tip portion of the first conveyance guide portion 94.

As shown in FIG. 10, a toner discharge port 100 for discharging toner stored in the storage space 85 to outside is formed in a lower region of an outer circumferential surface (hereinafter merely referred to as a lower surface) of the first conveyance guide portion 94. The toner discharge port 100 is a through-opening that penetrates, vertically downward, an outer circumferential wall constituting the lower surface of the first conveyance guide portion 94. The toner discharge port 100 is formed in an approximately square shape. In the present embodiment, the toner discharge port 100 is formed in an end portion of the lower surface of the first conveyance guide portion 94 at a position closest to the first input portion 98.

In addition, as shown in FIG. 8, the first conveyance guide portion 94 includes an inclined guide portion 942. The inclined guide portion 942 is integrally formed with the first conveyance guide portion 94, and is formed in an upper region of the arc-shaped circumferential surface (hereinafter merely referred to as an upper surface) of the first conveyance guide portion 94. The inclined guide portion 942 is, in the upper surface of the first conveyance guide portion 94, an inclined surface that is inclined diagonally downward toward the tip of the first conveyance guide portion 94 in the extension direction of the first conveyance guide portion 94 (toward the right in FIG. 10). The inclined guide portion 942 is formed in an end portion of the upper surface of the first conveyance guide portion 94 at a position closest to the first input portion 98, and is formed above the toner discharge port 100 in a side view (see FIG. 10). In the present embodiment, the inclined guide portion 942 is inclined downward at an inclination angle of 10 degrees from the upper surface of the first conveyance guide portion 94.

With the provision of the above-described inclined guide portion 942 in the first conveyance guide portion 94, an inner surface 9421 of the inclined guide portion 942 functions as a guide surface to guide the unused toner to the toner discharge port 100 in the inside of the first conveyance guide portion 94. As a result, when the unused toner is conveyed by the spiral member 95 along an arrow D32 of FIG. 10 toward the toner discharge port 100, the unused toner contacts the inner surface 9421, so that the advancing direction of the unused toner is oriented diagonally downward and the unused toner is guided toward the toner discharge port 100. With this configuration, the unused toner is prevented from remaining at the upper side of the tip portion of the spiral member 95 without being discharged. That is, it is possible to reduce a residual amount of the unused toner that remains unused in the tip portion of the first conveyance guide portion 94. In addition, since the inclination angle of the inclined guide portion 942 is 10 degrees, the unused toner is guided smoothly toward the toner discharge port 100 without excessively aggregating.

In the present embodiment, as shown in FIG. 12, the inclined guide portion 942 is formed on the upper surface of the first conveyance guide portion 94 at a position that is away by a predetermined angle θ from a vertical plane passing the rotation center of the spiral member 95 toward the upstream in the rotation direction D30. In the present embodiment, the predetermined angle θ is 45 degrees. That is, the inclined guide portion 942 is formed on the upper surface of the inclined guide portion 942 at a position that is away by 45 degrees from the vertical plane toward the upstream in the rotation direction D30. With the inclined guide portion 942 provided at such a position, the unused toner scraped up by the blades 97 contacts the inner surface 9421 and moves along the width direction D12 in the first conveyance guide portion 94. When the unused toner goes beyond the rotation shaft 96 of the spiral member 95, the unused toner falls down and is oriented toward the toner discharge port 100. This allows the unused toner to be guided to the toner discharge port 100 without receiving un excessive stress.

In addition, on the lower surface of the first conveyance guide portion 94, a shutter member 101 (an example of the opening and closing member) for opening and closing the toner discharge port 100 is provided. The shutter member 101 is supported by the first conveyance guide portion 94 in such a manner that the shutter member 101 can slide the lower surface of the first conveyance guide portion 94 in the longitudinal direction (the left-right direction of FIG. 10) of the first conveyance guide portion 94.

In the present embodiment, when the toner container 3M is attached to the attachment portion 58 (see FIG. 4), the shutter member 101 is moved from a closing position of closing the toner discharge port 100, to an opening position of opening the toner discharge port 100.

In addition, the toner discharge port 100 is aligned with the supply port 56 of the developing device 33 for positioning, then the toner discharge port 100 is connected to the supply port 56 so that toner can be supplied from the toner discharge port 100 to the supply port 56. In addition, the first input portion 98 is coupled with a first output joint 61 (an example of the drive output portion and the first drive coupling portion, see FIG. 13) that is provided in the attachment portion 58, and a rotational driving force output from a drive source such as a motor is transmitted to the first input portion 98. Upon receiving the rotational driving force, the spiral member 95 is rotated, and the toner in the storage space 85 is conveyed from the toner discharge port 100 to the supply port 56 via the first conveyance guide portion 94, and is supplied to the inside of the developing device 33.

It is noted that an engagement hole 611 which is rectangular in a cross section (see FIG. 13) is formed in the first output joint 61. The first input portion 98 is inserted in the engagement hole 611, thereby the first output joint 61 is engaged with the first input portion 98 in a direction of rotation around the axis. This allows the rotational driving force received from the first output joint 61 to be transmitted to the first input portion 98. In this case, the first input portion 98 is an example of the engaging portion.

As shown in FIG. 13, the first output joint 61 is provided in the attachment portion 58. The first output joint 61 is a drive output portion configured to output the rotational driving force that is output from a drive source such as a motor provided in the image forming apparatus 10, to the outside. The first output joint 61 is coupled with the first input portion 98 in the left-right direction D3 when the toner container 3M is attached to the attachment portion 58.

As shown in FIG. 5 and FIG. 9, a gear transmission mechanism 103 (an example of the transmission mechanism) is provided in the lid member 76. The gear transmission mechanism 103 is coupled with the rotation shaft 96 of the spiral member 95 and with a rotation shaft member 911 of the stirring member 91 in the state where the lid member 76 closes the opening portions 81 and 82. With this configuration, the rotational driving force transmitted from the first input portion 98 to the spiral member 95 is transmitted to the stirring member 91 by the gear transmission mechanism 103. That is, with the provision of the gear transmission mechanism 103, when the rotational driving force is input to the first input portion 98, the spiral member 95 and the stirring member 91 are rotated interlocking with each other.

The following describes the configuration of the gear transmission mechanism 103 with reference to FIG. 14 to FIG. 18.

The gear transmission mechanism 103 transmits the rotational driving force input to the rotation shaft 96 of the spiral member 95, from the end portion 961 of the rotation shaft 96 to the stirring member 91 via the concave recess portion 161 (end portion 161) of the rotation shaft member 911 of the stirring member 91. As shown in FIG. 18, the gear transmission mechanism 103 includes the first transmission portion 191, the second transmission portion 192, and an idle gear 193 provided between the first transmission portion 191 and the second transmission portion 192.

The first transmission portion 191 includes a first gear 1911 and the first coupling portion 1912. The first transmission portion 191 is a resin product in which the first gear 1911 and the first coupling portion 1912 are integrally formed.

The second transmission portion 192 includes a second gear 1921 and the second coupling portion 1922. The second transmission portion 192 is a resin product in which the second gear 1921 and the second coupling portion 1922 are integrally formed.

In the present embodiment, the first gear 1911, the second gear 1921 and the idle gear 193 are disposed on the surface of the lid member 76. Specifically, the first gear 1911, the second gear 1921 and the idle gear 193 are rotatably stored in a gear storage portion 188 of a concave shape (an example of the storage concave portion of a concave shape) formed on the surface of the lid member 76, in a state where the gears mesh with each other and the rotational force can be transmitted. The gear storage portion 188 is a concave portion recessed from the surface of the lid member 76 toward the inner surface 762 of the lid member. The first gear 1911, the second gear 1921 and the idle gear 193 are stored more on the inner side of the concave portion of the gear storage portion 188 than the surface of the lid member 76. That is, the first gear 1911, the second gear 1921 and the idle gear 193 are stored in the gear storage portion 188 in a state of being embedded in the inside of the gear storage portion 188. As a result, the gears 1911, 1921 and 193 keep the state of not projecting from the surface of the lid member 76 to outside.

The toner container 3M is gripped by the user during an attachment work to the attachment portion 58 or a replacement work. Accordingly, in a case where, for example, a rotational driving force is erroneously transmitted to the first input portion 98 and the gears 1911, 1921 and 193 are rotated when the user is detaching the toner container 3M from the image forming apparatus 10, the user may be injured by putting his/her fingers between the gears 1911, 1921 and 193. In addition, even if the gear transmission mechanism 103 is not operating, lubricant such as grease applied to the gears 1911, 1921 and 193 may adhere to the user's fingers and the fingers may be smeared. Furthermore, when the user grips the toner container 3M, the gears 1911, 1921 and 193 may be pushed by the user's fingers and positionally shifted, resulting in a damage of the gear transmission mechanism 103 during the driving. However, since the gears 1911, 1921 and 193 of the gear transmission mechanism 103 are stored in the gear storage portion 188, the user's fingers are prevented from touching the gears 1911, 1921 and 193. In particular, the user's fingers are prevented from touching the teeth of the gears 1911, 1921 and 193. As a result, it is possible to realize the toner container 3M that is free from the above-mentioned problems, has a low possibility of failure, and is safe.

As shown in FIG. 17, the first gear 1911 is disposed in a first storage portion 1881 that is provided in the gear storage portion 188. On an inner side surface of the first storage portion 1881, the bearing portion 99 is integrally formed therewith. The through hole 181 of the bearing portion 99 passes through up to the first storage portion 1881.

The first coupling portion 1912 extends from the first gear 1911 to the storage space 85 of the upper storage portion 71 via the through hole 181 formed in the bearing portion 99, and is coupled with the spiral member 95 of the first conveyance portion 92. Specifically, the first coupling portion 1912 includes a first shaft portion 196 and the first engaging portion 197, wherein the first shaft portion 196 is provided at the center of the first gear 1911 in a vertical direction thereto, and the first engaging portion 197 is provided on the tip side of the first shaft portion 196. In the state where the first gear 1911 is disposed in the first storage portion 1881, the first shaft portion 196 is inserted through the through hole 181 to the storage space 85 side, and is further inserted through the inner hole 178 of the end portion 961. The first engaging portion 197 is a hook-like member that projects outward from an outer circumferential surface of the first shaft portion 196 and extends toward the first gear 1911. In the present embodiment, the first engaging portion 197 is coupled with the engagement opening 9611 of the end portion 961 by the so-called snap-fitting system.

The first engaging portion 197 has elasticity in a radial direction vertical to the axial direction of the first shaft portion 196. Accordingly, when the first shaft portion 196 is inserted through the inner hole 178, the first engaging portion 197 receives a force in the radial direction from the inner wall of the end portion 961, and the first engaging portion 197 is elastically deformed toward the first shaft portion 196. As a result, the first shaft portion 196 can be inserted through the inner hole 178 without being interrupted by the first engaging portion 197. When the first shaft portion 196 is inserted through to the innermost part of the inner hole 178 and the first engaging portion 197 reaches the engagement opening 9611, the first engaging portion 197 is released from the elastic deformation, and returns to the original attitude. At this time, the first engaging portion 197 projects from the engagement opening 9611 to outside of the end portion 961, and an end portion of the first engaging portion 197 on the first gear 1911 side is engaged with an edge portion 9612 of the engagement opening 9611. This allows the first transmission portion 191 to be coupled with the rotation shaft 96 of the spiral member 95 by the first shaft portion 196 and the first engaging portion 197.

As shown in FIG. 16, the second gear 1921 is disposed in a second storage portion 1882 (an example of the second gear storage portion) that is provided in the gear storage portion 188. On an inner side surface of the second storage portion 1882, the boss 173 of the bearing portion 171 is integrally formed therewith. The through hole 174 of the boss 173 passes through up to the second storage portion 1882.

The second coupling portion 1922 extends from the second gear 1921 to the storage space 85 of the upper storage portion 71 via the through hole 174 formed in the boss 173 of the bearing portion 171, and is coupled with the rotation shaft member 911 of the stirring member 91. Specifically, the second coupling portion 1922 includes a second shaft portion 206 and a second engaging portion 207, wherein the second shaft portion 206 is provided at the center of the second gear 1921 in a vertical direction thereto, and the second engaging portion 207 is provided on the tip side of the second shaft portion 206. In the state where the second gear 1921 is disposed in the second storage portion 1882, the second shaft portion 206 is inserted through the through hole 174 to the storage space 85 side, and is further inserted through the engagement opening 1631 of the concave recess portion 161. The second engaging portion 207 includes two hooks that project outward from a side surface of the tip portion of the second shaft portion 206 and extends toward the second gear 1921. In the present embodiment, the second engaging portion 207 is coupled with the engagement opening 1631 of the concave recess portion 161 by the so-called snap-fitting system.

The second engaging portion 207 has elasticity in a radial direction vertical to the axial direction of the second shaft portion 206. Accordingly, when the second shaft portion 206 is inserted through the engagement opening 1631 via the through hole 174, the second engaging portion 207 receives a force in the radial direction from an edge portion 1632 of the engagement opening 1631, and the second engaging portion 207 is elastically deformed toward the second shaft portion 206. As a result, the second shaft portion 206 can be inserted through the engagement opening 1631 without being interrupted by the second engaging portion 207. When the second engaging portion 207 goes beyond the engagement opening 1631, the second engaging portion 207 is released from the elastic deformation, and returns to the original attitude. At this time, the second engaging portion 207 is engaged with the edge portion 1632 of the engagement opening 1631. This allows the second transmission portion 192 to be coupled with the rotation shaft member 911 of the stirring member 91 by the second shaft portion 206 and the second engaging portion 207.

As shown in FIG. 17, the idle gear 193 is disposed in a third storage portion 1883 that is provided in the gear storage portion 188. As shown in FIG. 18, the idle gear 193 is disposed between the first gear 1911 and the second gear 1921, and meshes with the first gear 1911 and the second gear 1921.

With the above-described configuration of the gear transmission mechanism 103, the rotational driving force transmitted from the first input portion 98 to the spiral member 95 is transmitted to the stirring member 91 by the gear transmission mechanism 103. By this way, when the spiral member 95 rotates, the stirring member 91 also rotates in the same direction as the spiral member 95.

It is noted that in the present embodiment, as shown in FIG. 14 and FIG. 15, a first inclined guide portion 194 and a second inclined guide portion 195 (both are examples of the inclined guide portion) are provided on the inner surface 762 of the lid member 76 in the vicinity of the gear storage portion 188. The inclined guide portions 194 and 195 are integrally formed with the lid member 76. The inclined guide portions 194 and 195 are provided in a rotational region of the projection portion 9122 on the inner surface 762 of the lid member 76. Specifically, as shown in FIG. 14, the first inclined guide portion 194 extends from an end portion 188A of the bottom portion 1885 of the gear storage portion 188 on the upstream side in the rotation direction D31, to the inner surface 762, and has an inclined surface that extends from the inner surface 762 to the bottom portion 1885 of the gear storage portion 188. In addition, as shown in FIG. 15, the second inclined guide portion 195 extends from an end portion 188B of the bottom portion 1885 of the gear storage portion 188 on the downstream side in the rotation direction D31, to the inner surface 762, and has an inclined surface that extends from the inner surface 762 to the bottom portion 1885 of the gear storage portion 188.

With the provision of the above-described inclined guide portions 194 and 195 on the inner surface 762, when the stirring member 91 rotates upon receiving the rotational driving force from the gear transmission mechanism 103, the projection portion 9122 of the stirring member 91 smoothly moves on the inclined surfaces of the inclined guide portions 194 and 195 while being bent along the inclined surfaces of the inclined guide portions 194 and 195. In addition, in a case where the unused toner stored in the upper storage portion 71 is reduced to a small amount, the projection portion 9122 can convey unused toner near the first inclined guide portion 194 to the spiral member 95 in a reliable manner. As a result, it is possible to prevent the unused toner from wastefully remaining in the upper storage portion 71. In addition, since the first inclined guide portion 194 is provided in a lower portion of the inner surface 762, it is possible to prevent the unused toner from aggregating in the lower portion of the storage space 85 of the upper storage portion 71.

As shown in FIG. 6, the lower storage portion 72 includes a second conveyance portion 105. Specifically, the second conveyance portion 105 for conveying the waste toner discharged from a drum unit 31 for magenta to the inside of the storage space 86 is provided in the storage space 86. The second conveyance portion 105 includes a second conveyance guide portion 107 and the spiral member 108, wherein the second conveyance guide portion 107 is cylindrical, extends outward from a wall surface 791 of the left side of the lower case 79, and includes a toner conveyance path in its inside, and the spiral member 108 (an example of the second rotation member, the rotation member, and the first conveyance member, see FIG. 11) is provided in the inside of the second conveyance guide portion 107. The second conveyance guide portion 107 is integrally formed with the lower case 79.

The spiral member 108 is rotatably provided in the inside of the lower storage portion 72, and as shown in FIG. 11, extends in the depth direction D13 perpendicular to the height direction D11. The spiral member 108 is a conveyance member that conveys the waste toner that has been discharged from the drum unit 31 to the second conveyance guide portion 107, to the storage space 86 through the inside of the second conveyance guide portion 107. In addition, the second conveyance guide portion 107 is a guide member that receives the waste toner from the drum unit 31, and guides the waste toner conveyed by the spiral member 108 to the inside of the storage space 86.

As shown in FIG. 11, the spiral member 108 includes spiral blades 110 around a rotation shaft 109. An end portion 1091 (an example of the second end portion) of the rotation shaft 109 of the spiral member 108 on the lid member 76 side is rotatably supported by a bearing portion 112 (an example of the second bearing portion) that is integrally formed with the inner surface 762 of the lid member 76. In addition, in a state where the spiral member 108 is inserted in the second conveyance guide portion 107, the opposite end of the rotation shaft 109 is rotatably supported by the second conveyance guide portion 107. Specifically, a second input portion 111 (an example of the second drive input portion and the first input joint) is mounted on an opposite end portion 1092 of the rotation shaft 109, wherein the second input portion 111 receives a rotational driving force input from outside.

In addition, the tip portion of the second conveyance guide portion 107 has a through hole 1071 (an example of the bearing hole and the bearing portion). Through the through hole 1071, the end portion 1092 of the rotation shaft 109 of the spiral member 108 passes through from the tip portion of the second conveyance guide portion 107 to outside, and the through hole 1071 rotatably supports the rotation shaft 109. With this configuration, the end portion 1092 is rotatably supported in the second conveyance guide portion 107 in the state where the rotation shaft 109 projects to outside from the through hole 1071. The second input portion 111 is attached to the end portion 1092. The second input portion 111 is fixed to the end portion 1092 from outside in the state where the end portion 1092 is passed through the through hole 1071 to outside.

In the following, the support structure of the end portion 1091 of the spiral member 108 is described concretely with reference to FIG. 19. Here, FIG. 19 is an enlarged view of a main part X3 that is enclosed by a two-dot chain line in FIG. 11.

As shown in FIG. 19, the end portion 1091 of the rotation shaft 109 (an example of the second rotation shaft) includes an inner hole 184 that extends along the axial direction from an end surface of the rotation shaft 109 on the lid member 76 side toward the opposite side. The inner hole 184 is formed in a circular shape.

In addition, as described above, the bearing portion 112 is provided on the inner surface 762 of the lid member 76. The bearing portion 112 includes a boss 185 that projects vertically from the inner surface 762 of the lid member 76. The boss 185 is inserted in the inner hole 184 of the end portion 1091, thereby the end portion 1091 is rotatably supported by the boss 185.

With the above-described configuration of the bearing portion 112 and the end portion 1091, when a rotational driving force is input to the rotation shaft 109 of the spiral member 108, the spiral member 108 is rotated in one direction in the storage space 86. In the present embodiment, the spiral member 108 is rotated in a rotation direction D32 (see FIG. 20A). This allows the waste toner discharged from the drum cleaning device 42 of the drum unit 31 to be conveyed in the second conveyance guide portion 107 to the storage space 86.

FIG. 20A and FIG. 20B are cross sections taken along an XX-XX line of FIG. 19. As shown in FIG. 20A and FIG. 20B, a film member 127 is formed in the vicinity of the spiral member 108. The film member 127 is formed as a thin film. The film member 127 is made of an elastic, synthetic resin material, such as a polyester or a PET (polyethylene terephthalate) resin. The film member 127 is formed approximately in a shape of a letter L by bending a film of a rectangular, flat plate shape formed from the synthetic resin material. The film member 127 includes a fixed portion 128 and a contact portion 129, wherein the fixed portion 128 is attached and fixed to an inner surface of the top wall 792 of the lower case 79, and the contact portion 129 extends downward from the fixed portion 128. The film member 127 is formed approximately in a shape of a letter L by the fixed portion 128 and the contact portion 129.

Meanwhile, the spiral member 108 as the conveyance member described above is configured such that its spiral blade contacts the toner. Accordingly, the toner may adhere to the spiral member 108. Once toner is adhered to the spiral member 108, a lump of the adhered toner gradually grows as toner continues to be adhered to the lump of toner. This causes the toner conveyance efficiency of the spiral member 108 to be reduced. On the other hand, it is possible to attach the elastic film member 127 to an inner wall of the toner container 3M and cause the film member 127 to contact the outer circumferential surface of the spiral member 108 so that the toner adhered to the spiral member 108 can be scraped off. However, if a length of the film member 127 from the inner wall is long, the elasticity of the film member 127 is weakened, and the film member 127 may not be able to scrape off, enough, the toner adhered to the spiral member 108. On the other hand, if the spiral member 108 is located close to the inner wall, the toner conveyance space is narrowed by the inner wall, and the conveyance efficiency is reduced. According to the present embodiment, however, with the configuration of the toner container 3M described below, it is possible to scrape off toner adhered to the spiral member 108 in a reliable manner without reducing the toner conveyance efficiency of the spiral member 108.

In the film member 127, the fixed portion 128 is fixed to the top wall 792 such that the contact portion 129 is disposed between the rib 771 and the spiral member 108. Specifically, the film member 127 is provided such that the contact portion 129 contacts a side plate 7713 of the rib 771, and the contact portion 129 contacts an outer circumferential surface of the spiral member 108. In this way, a side of the contact portion 129 is supported by the side plate 7713, thus the contact portion 129 contacts the outer circumferential surface of the spiral member 108 in the state where the contact portion 129 has a strong stiffness. As a result, if waste toner adheres to the spiral member 108, the waste toner is scraped off in a reliable manner by the contact with the contact portion 129.

In the present embodiment, as shown in FIG. 20A and FIG. 20B, a part of the spiral member 108 that contacts the contact portion 129 is formed in an oval shape in a cross section. As a result, when the spiral member 108 is rotated in the rotation direction D32, each time the spiral member 108 is rotated by a quarter rotation, the contact portion 129 changes its attitude between a first attitude and a second attitude, wherein in the first attitude (see FIG. 20A), the contact portion 129 is bent with a lower edge of the side plate 7713 as a fulcrum, and in the second attitude (see FIG. 20B), the contact portion 129 extends straight vertically downward from the fixed portion 128. With this configuration, when the spiral member 108 is rotated, the force that presses the outer circumferential surface of the spiral member 108 changes for each quarter rotation. As a result, the waste toner that has adhered to the spiral member 108 is scraped off in a reliable manner by the contact portion 129.

As shown in FIG. 11, the inlet 114 for guiding the waste toner to the inside of the storage space 86 is formed on the upper surface of the second conveyance guide portion 107. In addition, on the upper surface of the second conveyance guide portion 107, a shutter member 115 for opening and closing the inlet 114 is provided. The shutter member 115 is supported by the second conveyance guide portion 107 such that the upper surface of the second conveyance guide portion 107 can be slid in the longitudinal direction (the left-right direction of FIG. 11) of the second conveyance guide portion 107.

In the present embodiment, when the toner container 3M is attached to the attachment portion 58 (see FIG. 4), the shutter member 115 is moved from a closing position of closing the inlet 114, to an opening position of opening the inlet 114.

In addition, the inlet 114 is aligned with the discharge port 431 of the discharge guide portion 43 for positioning, then the inlet 114 is connected to the discharge port 431 so that waste toner can be conveyed from the discharge port 431 to the inlet 114. In addition, the second input portion 111 is coupled with a second output joint 62 (an example of the drive output portion and the first drive coupling portion, see FIG. 13) that is provided in the attachment portion 58, and a rotational driving force output from a drive source such as a motor is transmitted to the second input portion 111. Upon receiving the rotational driving force, the spiral member 108 is rotated, and the waste toner that has been discharged from the discharge port 431 and conveyed into the second conveyance guide portion 107 is conveyed to the storage space 86 through the second conveyance guide portion 107.

As shown in FIG. 13, the second output joint 62 is provided in the attachment portion 58, at a position different from the first output joint 61. The second output joint 62 is a drive output portion configured to output the rotational driving force that is output from a drive source such as a motor provided in the image forming apparatus 10, to the outside. The second output joint 62 is coupled with the second input portion 111 in the left-right direction D3 when the toner container 3M is attached to the attachment portion 58.

As shown in FIG. 22A and FIG. 22B, the second output joint 62 includes a base portion 621 and four engaging pieces 623. The base portion 621 is a portion that is to be attached to the attachment portion 58, and is, for example, a disk-like member having a circular shaft hole 624 at its center. The base portion 621 is integrally formed with at least two engaging pieces 623. In the present embodiment, four engaging pieces 623 are formed on the base portion 621. The four engaging pieces 623 project from the surface of the base portion 621. The shaft hole 624 is formed at the center of the base portion 621, and the four engaging pieces 623 are arranged at equal intervals around the axis of the shaft hole 624. It is noted that the number of engaging pieces 623 is not limited to four, but, for example, two engaging pieces 623 may be arranged at equal intervals around the shaft hole 624.

As shown in FIG. 22B, each of the four engaging pieces 623 includes a first inclined surface 625 and a vertical surface 626, wherein the first inclined surface 625 is inclined from a projection end of the engaging piece 623 toward the base portion 621, and the vertical surface 626 is formed on the opposite side to the first inclined surface 625 across the projection end. The vertical surface 626 is vertical to the surface of the base portion 621.

The projection end of each of the four engaging pieces 623 is formed in a tapered shape. The projection end of each of the engaging pieces 623 has a second inclined surface 627. The second inclined surface 627 is formed by chamfering a corner portion between the first inclined surface 625 and the vertical surface 626 (the projection end of the engaging piece 623). The second inclined surface 627 is inclined toward the first inclined surface 625 and the vertical surface 626. The second inclined surface 627 has a role of, when the second input portion 111 is inserted in the second output joint 62, guiding a projection piece 113 of the second input portion 111 to a gap 628 between adjacent engaging pieces 623. For example, when the projection piece 113 contacts the second inclined surface 627, the projection piece 113 slides on the second inclined surface 627 and enters the gap 628.

On the other hand, as described above, the second input portion 111 is mounted on the end portion 1092 of the rotation shaft 109 of the spiral member 108. As shown in FIG. 23A and FIG. 23B, the second input portion 111 includes a base portion 1111, a projection shaft 1112, and two projection pieces 113. The base portion 1111 is formed in a disk shape. The projection shaft 1112 is a boss-like member projecting from the center of the base portion 1111 in a vertical direction. An insertion hole is formed at the center of a rear surface of the base portion 1111, and the insertion hole reaches an inside of the projection shaft 1112. That is, the inside of the projection shaft 1112 is hollow. A pair of cuts 1114 are formed on the circumferential surface of the projection shaft 1112. A pair of arms are formed on the end portion 1092 of the rotation shaft 109, wherein the pair of arms extend in the axial direction, and a hook is formed on the tip of each of the arms. When the pair of arms are inserted in the inside of the projection shaft 1112, the hooks respectively enter the cuts 1114. This allows the second input portion 111 to be attached to the end portion 1092 by the so-called snap-fitting system.

Each of the pair of projection pieces 113 is formed so as to be tapered toward the projection end of the projection shaft 1112. The projection pieces 113 can be engaged with two engaging pieces 623 among the four engaging pieces 623. In the present embodiment, a projection piece 1131 (an example of the first piece) of the two projection pieces 113 includes an abutting surface 1133 (an example of the first abutting surface) that contacts the vertical surface of an engaging piece 623. The abutting surface 1133 is a vertical surface vertical to the surface of the base portion 1111. The other projection piece 1132 (an example of the second piece) of the two projection pieces 113 is formed at a position that is away by 180 degrees from the projection piece 1131 around the axis. The projection piece 1132 includes an abutting surface 1134 (an example of the second abutting surface) that contacts the vertical surface of another engaging piece 623. The abutting surface 1134 is a vertical surface vertical to the surface of the base portion 1111. The abutting surfaces 1133 and 1134 are portions that receive the rotational driving force from the second output joint 62.

In the present embodiment, as shown in FIG. 23B, one projection piece 1131 is longer in the projection direction of the projection shaft 1112 than the other projection piece 1132. With this configuration, during the attachment process of the toner container 3M to the attachment portion 58, even if the toner container 3M is moved toward the attachment portion 58 in an inclined state, the second input portion 111 is smoothly coupled with the second output joint 62 in a reliable manner. That is, as shown in FIG. 24A, when the second input portion 111 approaches the second output joint 62, first the projection piece 1131, the longer projection piece, enters the gap 628. At this time, if the projection piece 1131 contacts a portion other than the gap 628, such as the first inclined surface 625, the projection piece 1131 is guided to the gap 628 by the first inclined surface 625. In addition, if the projection piece 1131 contacts the second inclined surface 627, the projection piece 1131 is guided to the gap 628 by the second inclined surface 627. At this time, the projection piece 1132, the shorter projection piece, is not contacting any engaging piece 623. Thus, the guidance of the projection piece 1131 to the gap 628 is not interrupted by the projection piece 1132. When the projection piece 1131 contacts and is guided by the first inclined surface 625 or the second inclined surface 627, the second input portion 111 pivots around the axis, and the shorter projection piece 1132 is disposed at a position to face the gap 628. As shown in FIG. 24B, when the second input portion 111 further approaches the second output joint 62, the shorter projection piece 1132 enters the gap 628.

Here, FIG. 25A is a perspective view of a second input portion 111A having a conventional configuration, and FIG. 25B is a perspective view of a second output joint 62A having a conventional configuration. In addition, FIG. 26 is a plan view of the second output joint 62A having a conventional configuration. In these drawings, components that are the same as those of the present embodiment are assigned the same reference signs. The conventional second input portion 111A shown in FIG. 25A includes two projection pieces 113, but these projection pieces 113 have the same length. As a result, when the toner container 3M is moved toward the attachment portion 58 in an inclined state, one front end 113A (a portion represented by a dotted line in FIG. 26) of the two projection pieces 113 enters the gap 628, but the other front end 113B (a portion represented by a dotted line in FIG. 26) may be caught by the front end of the first inclined surface 625. However, according to the present embodiment, such a catching does not occur, and thus, when the toner container 3M is attached to the attachment portion 58, the second input portion 111 is coupled with the second output joint 62 in a reliable manner.

As described above, in the present embodiment, the central flange 832 is provided so as to couple the upper case 78 of the upper storage portion 71 with the lower case 79 of the lower storage portion 72. As a result, even if, due to a production error or the like, the first input portion 98 and the second input portion 111 are positionally deviated, or the first output joint 61 and the second output joint 62 are positionally deviated, the toner container 3M can be bent at the vicinity of the gap 88 when the toner container 3M is attached to the attachment portion 58, so that the first input portion 98 is aligned with the first output joint 61, and the second input portion 111 is aligned with the second output joint 62 for positioning. This allows the first input portion 98 to be coupled with the first output joint 61, and the second input portion 111 to be coupled with the second output joint 62, smoothly in a reliable manner. In addition, in a case where the rotational driving force is transmitted in the state where the toner container 3M is attached to the attachment portion 58, even if, due to a positional deviation, a load is applied to the input portions 98 and 111 or the output joints 61 and 62, the load escapes toward the central flange 832 and bends the toner container 3M at the vicinity of the gap 88. With this configuration, it is possible to distribute the load of the input portions 98 and 111 or the output joints 61 and 62 and prevent the input portions 98 and 111 or the output joints 61 and 62 from being damaged.

As shown in FIG. 8, the first conveyance portion 92 and the second conveyance portion 105 are separated from each other in the width direction D12. Specifically, the first conveyance portion 92 is provided on the wall surface 781 of the upper storage portion 71 at a position close to a side portion on one side (the front side) in the width direction D12. In addition, the second conveyance portion 105 is provided on the wall surface 791 of the lower storage portion 72 at a position close to a side portion on the opposite side (the rear side) in the width direction D12.

As shown in FIG. 7 and FIG. 9, the toner container 3M includes a gripping portion 122 having a concave portion 123. The gripping portion 122 is a portion that is gripped by the user when the user carries or performs a replacement of the toner container 3M. In the present embodiment, the concave portion 123 is formed in one side of the container main body 75 in the width direction D12. More specifically, the concave portion 123 is formed between the upper storage portion 71 and the lower storage portion 72 in a side portion on the front side while the toner container 3M is in an attachment attitude of being attached to the attachment portion 58. The concave portion 123 passes through the toner container 3M in the depth direction D13, and when the toner container 3M is viewed from the lid member 76 side, the concave portion 123 is rectangular. With the formation of the concave portion 123, the toner container 3M has the gripping portion 122 that is a narrowed, constricted portion. Since, the gripping portion 122 is formed in a constricted shape so as to be easily held by the user, the user can easily place his/her fingers on the gripping portion 122, easily carry the toner container 3M, and easily perform the replacement work. It is noted that since the lid member 76 is formed in the shape that matches the shape of the container main body 75, the lid member 76 also has a constricted portion in correspondence with the gripping portion 122.

It is noted that as shown in FIG. 5, in the toner container 3K, the concave portion 123 is formed in each of the side portions on opposite sides in the width direction D12.

As shown in FIG. 7, the concave portion 123 is provided in an upper portion of the lower storage portion 72. As a result, under the constraint that the toner container 3M cannot be increased in size, the presence of the concave portion 123 reduces the capacity of the storage space 86 of the lower storage portion 72. However, since the lower storage portion 72 is configured to store waste toner, the upper space of the storage space 86 is never filled until the storage space 86 is filled with the waste toner. For this reason, the concave portion 123 is preferably formed in the lower storage portion 72. The upper storage portion 71 is configured to store unused toner. As a result, if the concave portion 123 is formed in the upper storage portion 71, the storage space 85 of the upper storage portion 71 cannot secure a prescribed capacity required to store the unused toner. Thus it is not preferable to form the concave portion 123 in the upper storage portion 71.

In addition, the concave portion 123 is formed in proximity to the first conveyance portion 92, more specifically, directly under the shutter member 101 of the first conveyance portion 92. When the toner container 3M is attached to or detached from the attachment portion 58, the shutter member 101 is opened or closed, and the opening or closing of the shutter member 101 generates a sliding resistance. When performing a replacement work of the toner container 3M, the user feels the sliding resistance as a load. However, the concave portion 123 is provided directly under the shutter member 101. Thus, when performing a replacement work of replacing the toner container 3M by gripping the gripping portion 122, the user can easily apply a force to the gripping portion 122, and can directly transmit a force to the shutter member 101. With this configuration, the workability during the replacement work is improved.

As shown in FIG. 5 and FIG. 9, the toner container 3M includes an identification label 126 that indicates the type of the toner container 3M (for example, the color of the toner, model number or the like). The identification label 126 is a sheet-like member whose rear side is coated with an adhesive such as paste, and characters and/or symbols indicating the type are written on the front side thereof. The identification label 126 is stuck to the surface of the lid member 76. Specifically, the identification label 126 is stuck to a region in an outer surface of the lid member 76 that corresponds to the gripping portion 122. According to conventional toner containers, the container main body 75 or the lid member 76 of the toner container 3M is colored to the color of the toner stored therein so that the type thereof can be identified. On the other hand, in the present embodiment, the identification label 126 is used to make the toner container 3 identifiable. This makes it possible to unify the toner containers 3 for color printing.

As shown in FIG. 12, an IC substrate 64 is mounted on an upper portion of the wall surface 781 of the upper case 78, wherein the IC substrate 64 includes a plurality of contact terminals 67. The upper portion of the wall surface 781 includes a concave recess portion 783 that is recessed from the wall surface 781 by one stage. Specifically, the concave recess portion 783 is formed on the wall surface 781 to continue to the upper end of the wall surface 781. The concave recess portion 783 is lower than the wall surface 781 by one stage. The concave recess portion 783 is formed to extend over the whole region of the upper portion of the wall surface 781 in the width direction D12. The IC substrate 64 is disposed on the concave recess portion 783. More specifically, the IC substrate 64 is disposed at the center of the concave recess portion 783 in the width direction D12.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner container comprising:

an elongated container main body configured to store toner in an inside thereof, a rotation member rotatably provided in the container main body and extending in a depth direction of the container main body, the depth direction being perpendicular to a longitudinal direction of the container main body;

a flat plate-like lid member closing an opening portion formed in one side of a housing of the container main body in the depth direction;

a rib member provided on an inner surface of the lid member in such a way as to be located adjacent to the rotation member with a predetermined gap from the rotation member, and configured to position the lid member with respect to the opening portion; and a film member attached to a wall surface of the housing of the container main body and extending from the wall surface toward the gap such that one surface of the film member contacts the rib member and an opposite surface of the film member contacts an outer circumferential surface of the rotation member.

2. The toner container according to claim 1, wherein the container main body includes:

a first toner storage portion provided in one side of the container main body in the longitudinal direction of the container main body; and a second toner storage portion provided in the other side of the container main body in the longitudinal direction, wherein a partition wall is provided between the first toner storage portion and the second toner storage portion, the lid member closes an opening portion of a first housing of the first toner storage portion and an opening portion of a second housing of the second toner storage portion, the opening portions being formed in one side of the first housing and the second housing in the depth direction, the rotation member is rotatably provided in the second toner storage portion, the rib member positions the lid member with respect to the opening portion of the second housing of the second toner storage portion, and the film member projects from the partition wall toward an inside of the second toner storage portion.

3. The toner container according to claim 2, wherein the toner container is attached to an attachment portion included in an image forming apparatus such that the longitudinal direction matches an up-down direction, the first toner storage portion is configured to store unused toner in an inside thereof, and is provided in an upper part of the container main body while the toner container is in an attachment attitude of being attached to the attachment portion, the second toner storage portion is configured to store, in an inside thereof, used toner collected from the image forming apparatus, and is provided in a lower part of the container main body below the first toner storage portion while the toner container is in the attachment attitude, and the rotation member is a conveyance member configured to convey the used toner to the inside of the second toner storage portion by being rotated.

4. The toner container according to claim 2, wherein the film member includes a fixed portion and a contact portion, the fixed portion being attached to the partition wall, the contact portion extending from the fixed portion toward the gap and contacting the rib member and the rotation member.

5. The toner container according to claim 1, wherein a part of the rotation member that contacts the film member is formed in an oval shape in a cross section.

6. An image forming apparatus comprising:

an apparatus main body;

a developing device included in the apparatus main body;

a drum unit including a rotatable photoconductor drum configured to carry a toner image developed by the developing device;

a cleaning portion included in the drum unit and configured to remove used toner that has remained on the photoconductor drum and convey the removed toner toward one side in an axial direction of a rotation shaft of the photoconductor drum; and a toner container attached, in a detachable manner, to an attachment portion included in the apparatus main body at a position that is more on the one side in the axial direction than the drum unit, and elongated in an up-down direction while the toner container is in an attachment attitude of being attached to the attachment portion, wherein the toner container includes:

a first toner storage portion configured to store unused toner that is to be supplied to the developing device, and provided in an upper part of the toner container while the toner container is in the attachment attitude;

a first rotation member rotatably provided in the first toner storage portion, extending in a depth direction perpendicular to the up-down direction, and configured to convey the unused toner to the developing device by being rotated;

a second toner storage portion configured to store the used toner conveyed from the cleaning portion, and provided in a lower part of the toner container below the first toner storage portion while the toner container is in the attachment attitude, wherein a partition wall is provided between the first toner storage portion and the second toner storage portion;

a second rotation member rotatably provided in the second toner storage portion, extending in the depth direction, and configured to convey the used toner conveyed from the cleaning portion, to the second toner storage portion by being rotated;

a flat plate-like lid member closing an opening portion of a first housing of the first toner storage portion and an opening portion of a second housing of the second toner storage portion, the opening portions being formed in one side of the first housing and the second housing in the depth direction;

a rib member provided on an inner surface of the lid member in such a way as to be located adjacent to the second rotation member with a predetermined gap from the second rotation member, and configured to position the lid member with respect to the opening portion of the second housing of the second toner storage portion; and a film member attached to the partition wall and extending from the partition wall toward the gap such that one surface of the film member contacts the rib member and an opposite surface of the film member contacts an outer circumferential surface of the second rotation member.

* * * * *